US010183509B2

(12) United States Patent
Kobayashi et al.

(10) Patent No.: US 10,183,509 B2
(45) Date of Patent: Jan. 22, 2019

(54) SHEET SUPPLYING APPARATUS AND PRINTING APPARATUS

(71) Applicant: CANON KABUSHIKI KAISHA, Tokyo (JP)

(72) Inventors: Ryo Kobayashi, Kawasaki (JP); Toshiaki Yamaguchi, Machida (JP); Masaki Sumioka, Yokohama (JP); Itaru Wada, Tokyo (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/408,711

(22) Filed: Jan. 18, 2017

(65) Prior Publication Data

US 2017/0120636 A1 May 4, 2017

Related U.S. Application Data

(62) Division of application No. 14/939,115, filed on Nov. 12, 2015, now Pat. No. 9,592,683.

(30) Foreign Application Priority Data

Nov. 19, 2014 (JP) ..... 2014-234755
Aug. 25, 2015 (JP) ..... 2015-165838

(51) Int. Cl.
*B65H 23/16* (2006.01)
*B41J 15/04* (2006.01)
(Continued)

(52) U.S. Cl.
CPC ..... *B41J 15/04* (2013.01); *B41J 15/16* (2013.01); *B65H 16/028* (2013.01); *B65H 16/103* (2013.01); *B65H 23/16* (2013.01); *B65H 16/02* (2013.01); *B65H 16/10* (2013.01); *B65H 20/02* (2013.01); *B65H 23/04* (2013.01); *B65H 23/06* (2013.01); *B65H 23/08* (2013.01); *B65H 23/085* (2013.01); *B65H 2301/41342* (2013.01);
(Continued)

(58) Field of Classification Search
None
See application file for complete search history.

(56) References Cited

U.S. PATENT DOCUMENTS 1,893,891 A 1/1933 Halliwell
1,945,136 A 1/1934 Cline
(Continued)

FOREIGN PATENT DOCUMENTS

JP 11-011750 A 1/1999
JP 2002-348011 A 12/2002
(Continued)

*Primary Examiner* — Jill E Culler
(74) *Attorney, Agent, or Firm* — Venable LLP

(57) ABSTRACT

A printing apparatus is configured to perform in a first mode in which a second driving unit drives a second spool to feed out a sheet from a roll to a printing unit via a second guide, the printing unit performs printing on the fed sheet, and a basket unit receives the printed sheet printed on by the printing unit, and a second mode in which a first driving unit drives a first spool to feed the out the sheet from a roll to the printing unit via a first guide, the printing unit performs printing on the fed sheet, and the second driving unit drives the second spool to wind up the printed sheet printed by the printing unit as a roll.

17 Claims, 30 Drawing Sheets

(51) Int. Cl.

| | |
|---|---|
| ***B41J 15/16*** | (2006.01) |
| ***B65H 16/02*** | (2006.01) |
| ***B65H 16/10*** | (2006.01) |
| *B65H 23/04* | (2006.01) |
| *B65H 23/08* | (2006.01) |
| *B65H 23/06* | (2006.01) |
| *B65H 20/02* | (2006.01) |

(52) U.S. Cl.

CPC ..... *B65H 2301/41368* (2013.01); *B65H 2301/41376* (2013.01); *B65H 2301/41461* (2013.01); *B65H 2301/41509* (2013.01); *B65H 2301/415185* (2013.01); *B65H 2404/434* (2013.01); *B65H 2404/612* (2013.01); *B65H 2515/31* (2013.01); *B65H 2701/1311* (2013.01); *B65H 2801/36* (2013.01)

(56) References Cited

U.S. PATENT DOCUMENTS

| | | | | |
|---|---|---|---|---|
| 2,053,022 | A | 9/1936 | Corswandt | |
| 2,686,013 | A * | 8/1954 | Christian | B65H 18/103 242/538.1 |
| 3,649,447 | A | 3/1972 | Turner | |
| 3,670,980 | A * | 6/1972 | Mukai | B65H 18/10 242/547 |
| 4,570,870 | A | 2/1986 | Ito | |
| 4,998,121 | A | 3/1991 | Koh et al. | |
| 5,043,763 | A | 8/1991 | Koh et al. | |
| 5,153,655 | A | 10/1992 | Suzuki et al. | |
| 5,157,444 | A | 10/1992 | Mori et al. | |
| 5,308,008 | A * | 5/1994 | Ruegg | B65H 18/26 242/541.7 |
| 5,758,982 | A | 6/1998 | Yoshida et al. | |
| 5,868,893 | A | 2/1999 | Kipper et al. | |
| 2013/0277482 | A1 * | 10/2013 | Naramatsu | B65H 23/063 242/334 |
| 2015/0328906 | A1 | 11/2015 | Sumioka et al. | |

FOREIGN PATENT DOCUMENTS

| | | | |
|---|---|---|---|
| JP | 2003-012205 | A | 1/2003 |
| JP | 2013-116561 | A | 6/2013 |

* cited by examiner

START
S3
INSERT TIP OF SHEET (1)
S61
DETECT TIP OF SHEET (1) BY SHEET SENSOR (6a)
S62
DISPLAY "START SHEET FEEDING? " ON PANEL
S63
SELECT "START"
S64
"CLOSE DUST ROLL COVER"DISPLAYED ON PANEL
S65
CLOSE COVER (42)
S66
ROTATE ROLL DRIVING MOTOR (33a) REVERSELY
S67
NO SHEET (1) DETECTED BY SHEET SENSOR (6a)
S68
ROTATE ROLL DRIVING MOTOR (33a) FORWARD AT CONSTANT SPEED V0
S69
DETECT TIP OF SHEET (1) BY SHEET SENSOR (6a)

SHEET SUPPLYING APPARATUS AND PRINTING APPARATUS

BACKGROUND OF THE INVENTION

Field of the Invention

The present invention relates to a sheet supplying apparatus that draws a sheet out of a sheet roll, in which a sheet is wound in a rolled manner, so as to supply the sheet, and a printing apparatus.

Description of the Related Art

It has been known a printing apparatus provided with a sheet supplying apparatus that draws a sheet out of a sheet roll so as to supply the sheet, wherein the printing apparatus prints an image on a sheet supplied from the sheet supplying apparatus. A sheet supplying apparatus provided for a printing apparatus disclosed in Japanese Patent Laid-Open No. H11-11750 (1999) is configured to convey a sheet drawn out of a sheet roll upward through a conveyance path that is formed between a movable type separating flapper and a conveyance guide and extends from under to above. The movable type separating flapper is pressed at the lower end thereof against the outer periphery of the sheet roll, thereby separating the tip of the sheet from the sheet roll.

In the sheet supplying apparatus disclosed in Japanese Patent Laid-Open No. H11-11750 (1999), the separating flapper moves as the outer diameter of the sheet roll becomes smaller so that the conveyance path formed between the separating flapper and the conveyance guide enlarges. The sheet drawn out of the sheet roll is conveyed upward against the weight of the sheet through the conveyance path that enlarges in the above-described manner, and therefore, buckling possibly occurs. In addition, since a sheet drawn out of a sheet roll having a small outer diameter is strongly curled, the sheet is hardly conveyed through the conveyance path in a smooth manner.

SUMMARY OF THE INVENTION

The present invention provides a sheet supplying apparatus that can securely draw a sheet out of a sheet roll irrespective of the size of the outer diameter of the sheet roll so as to convey the sheet, and a printing apparatus.

In one aspect of the present invention there is provided an inkjet printing apparatus having a printing unit configured to perform inkjet printing on a sheet that is continuous, a basket unit configured to receive a sheet on which an image is printed by the printing unit, a first driving unit configured to apply a rotational force to a first spool that holds a roll of the sheet, a first pressing roller configured to press an outer peripheral surface of the roll held by the first spool, wherein the first pressing roller is movable according to reducing of an outer diameter of the roll, a first guide configured to move in association with the movement of the first pressing roller so as to guide the sheet drawn from the roll toward the printing unit, a second driving unit configured to apply a rotational force to a second spool that holds a roll of the sheet, a second pressing roller configured to press an outer peripheral surface of the roll held by the second spool, wherein the second pressing roller is movable according to reducing of an outer diameter of the roll held by the second spool, and a second guide configured to move in association with the movement of the second pressing roller so as to guide the sheet drawn from the roll toward the printing unit. The printing apparatus is configured to perform (a) a first mode in which the second driving unit drives the second spool to feed out the sheet from the roll to the printing unit via the second guide, the printing unit performs printing on the fed sheet, and the basket unit receives the printed sheet printed by the printing unit, and (b) a second mode in which the first driving unit drives the first spool to feed out the sheet from the roll to the printing unit via the first guide, the printing unit performs printing on the fed sheet, and the second driving unit drives the second spool to wind up the printed sheet printed by the printing unit as a roll.

In the another aspect of the present invention, there is provided a sheet supplying apparatus that draws a sheet out of a sheet roll and supplies the sheet, the sheet supplying apparatus comprising:

a pressing unit having a roller configured to move according to an outer diameter of the sheet roll, to be brought into press-contact with an outer periphery of the sheet roll from below, with respect to the direction of gravity; and a lower guide member configured to move in association with the pressing unit so as to guide a lower surface of the sheet that is drawn through the pressing unit.

In the yet another aspect of the present invention, there is provided a sheet winding apparatus that winds a sheet in a form of a sheet roll, the sheet winding apparatus comprising:

a pressing unit having a roller configured to move according to an outer diameter of the sheet roll, to be brought into press-contact with an outer periphery of the sheet roll from below, with respect to the direction of gravity;

a lower guide member configured to move in association with the pressing unit so as to guide a lower surface of the sheet that is drawn through the pressing unit; and a winding/driving mechanism configured to rotate the sheet roll in a winding direction of the sheet.

In the third aspect of the present invention, there is provided a printing apparatus comprising:

a sheet supplying apparatus that draws a sheet out of a sheet roll and supplies the sheet, the sheet supplying apparatus comprising a pressing unit having a roller configured to move according to an outer diameter of the sheet roll, to be brought into press-contact with an outer periphery of the sheet roll from under in a gravity direction, and a lower guide member configured to move in association with the pressing unit so as to guide a lower surface of the sheet that is drawn through the pressing unit; and a print unit configured to print an image on the sheet to be supplied from the sheet supplying apparatus.

In the still yet another aspect of the present invention, there is provided a printing apparatus comprising:

a sheet winding apparatus that winds a sheet in a form of a sheet roll, the sheet winding apparatus comprising a pressing unit having a roller configured to move according to an outer diameter of the sheet roll, to be brought into press-contact with an outer periphery of the sheet roll from below, with respect to the direction of gravity, a lower guide member configured to move in association with the pressing unit so as to guide a lower surface of the sheet that is drawn through the pressing unit, and a winding/driving mechanism configured to rotate the sheet roll in a winding direction of the sheet; and a print unit configured to print an image on the sheet to be wound by the sheet winding apparatus.

According to the present invention, the pressing unit is brought into press-contact with the outer periphery of the sheet roll from under, and furthermore, the lower side of the sheet drawn through the pressing unit is guided by the lower guide member, so that the sheet can be smoothly guided and supplied. Moreover, the pressing unit and the lower guide member move according to the outer diameter of the sheet roll, and therefore, the sheet can be securely drawn out of the sheet roll irrespective of the size of the outer diameter of the sheet roll, and then, conveyed.

Further features of the present invention will become apparent from the following description of exemplary embodiments (with reference to the attached drawings).

DESCRIPTION OF THE EMBODIMENTS

Embodiments of the present invention will be described below with reference to the attached drawings.

First Embodiment

FIGS. 1 to 8 are views illustrating a first embodiment of the present invention. In the present embodiment, the present invention is applied to an ink jet printing apparatus provided with a sheet supplying apparatus that supplies a sheet serving as a print medium and a print unit that prints an image on the sheet.

Figure 1:
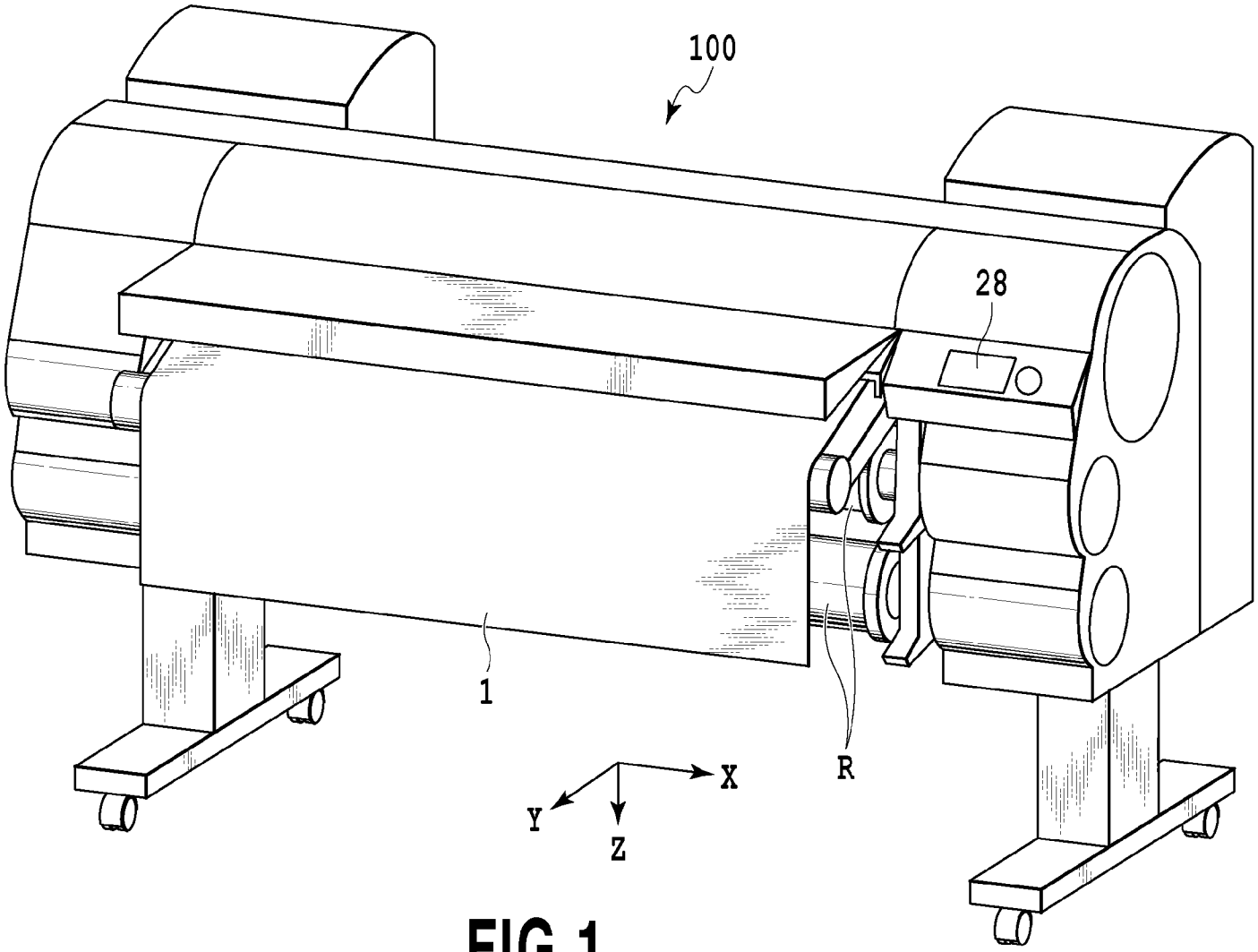
FIG. 1 is a perspective view showing a printing apparatus in a first embodiment of the present invention.

As shown in FIG. 1, two of sheet rolls R, around each of which a sheet 1 is wound in a roll-like manner, can be set in a printing apparatus 100. An image is printed on the sheet 1 that is selectively drawn out of either of the sheet rolls R. A user can input various kinds of commands with respect to the printing apparatus 100 via various kinds of switches provided on an operation panel 28 so as to designate the size of the sheet 1 or switch between on-line and off-line.

Figure 2:
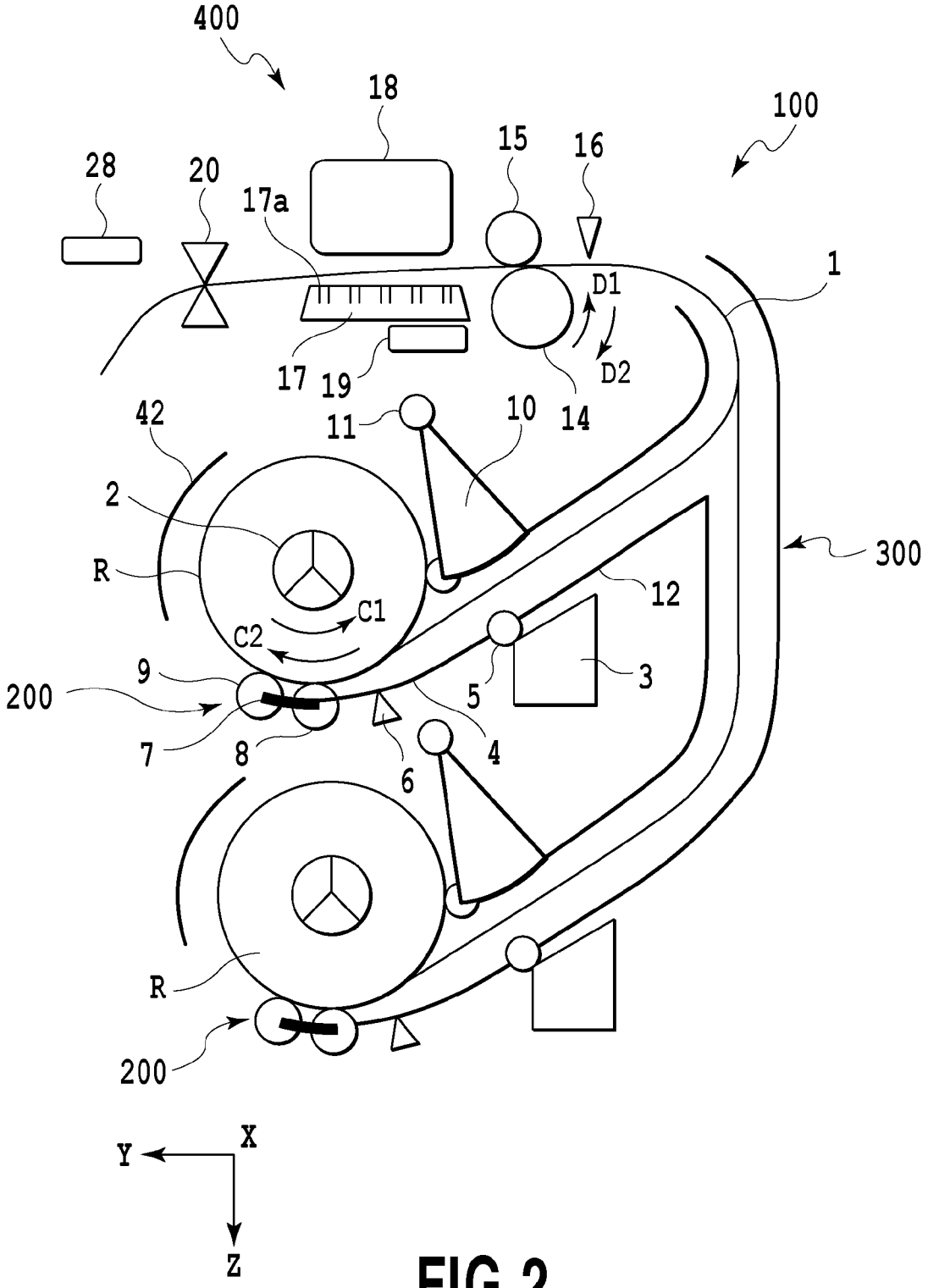
FIG. 2 is a view illustrating a sheet conveyance path in the printing apparatus.

FIG. 2 is a cross-sectional view schematically showing essential parts of the printing apparatus 100. Two sheet supplying apparatuses 200 are vertically arranged in a manner corresponding to the two sheet rolls R. The sheet 1 drawn out of the sheet roll R by the sheet supplying apparatus 200 is conveyed to a print unit 400 capable of printing an image by a sheet conveying unit (i.e., a conveying mechanism) 300. The print unit 400 allows ink to be ejected from an ink jet print head 18 so as to print an image on the sheet 1. The print head 18 ejects ink through an ejection port by using ejection energy generating element such as an electrothermal transducer (i.e., a heater) or a piezoelectric element. In the case of the use of the electrothermal transducer, its heat generation enables ink to be foamed, so that the resultant foaming energy enables ink to be ejected through the ejection port. The print system of the print head 18 is not limited to only an ink jet system. Moreover, the print system of the print unit 400 is not limited, and therefore, it may be, for example, of a serial scanning system or a full line system. In the case of the serial scanning system, a conveying operation of the sheet 1 and a scanning operation by the print head 18 in a direction transverse a conveyance direction of the sheet 1 are performed while an image is printed. In the case of the full line system, the sheet 1 is sequentially conveyed while an elongated print head 18 that extends in the direction transverse the conveyance direction of the sheet 1 prints an image.

A spool member 2 formed into a shaft-like shape is inserted into a hollow hole of the sheet roll R, and then, the spool member 2 is driven forward or reversely by a roll driving motor, described later. In this manner, the sheet roll R is held at the center thereof, to be thus rotated forward and reversely in directions indicated by arrows C1 and C2. The supplying apparatus 200 is provided with a drive unit 3, an arm member (i.e., a moving member) 4, an arm turning shaft 5, a first sheet sensor 6, an oscillating member 7, driven rollers 8 and 9 (i.e., pressing units), a separating flapper (i.e., an upper guide member) 10, and a flapper swing shaft 11, as described later.

A conveyance guide 12 guides the obverse and reverse of the sheet 1 drawn out of the supplying apparatus 200 while guiding the sheet 1 to the print unit 400. A conveyance roller 14 is rotated forward and reversely in directions indicated by arrows D1 and D2 by a conveyance roller driving motor, described later. A nip roller 15 can be rotated following the rotation of the conveyance roller 14, and furthermore, can be brought into or out of contact with the conveyance roller 14 by a nip roller separating motor, not shown. Moreover, the nip roller 15 can adjust nipping force. The conveyance roller 14 is rotated upon detection of the tip of the sheet 1 by a second sheet sensor 16. A conveyance speed of the sheet 1 by the conveyance roller 14 is set to be higher than the drawing speed of the sheet 1 according to the rotation of the sheet roll R, and thus, back tension can be applied to the sheet 1 that can be conveyed in the tensile state. Consequently, it is possible to prevent the sheet 1 from sagging, so as to suppress the generation of folds on the sheet 1 or a conveyance error.

A platen 17 at the print unit 400 adsorbs the reverse of the sheet 1 through suction holes 17*a* under vacuum generated by a suction fan 19. In this manner, the position of the sheet 1 is restricted along the platen 17, so that the print head 18 can print an image with high accuracy. A cutter 20 can cut the sheet 1 having the image printed thereon. A cover 42 for the sheet roll R prevents the sheet 1 having the image printed thereon from returning to the supplying apparatus 200. The operation of the printing apparatus 100 is controlled by a CPU, described later.

Figure 3A:
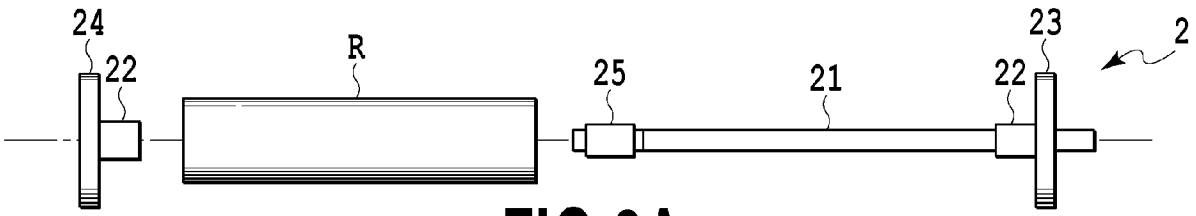
FIG. 3A is an exploded view showing a spool in a sheet supplying apparatus.
Figure 3B:
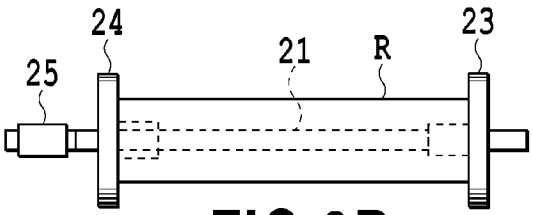
FIG. 3B is a front view showing the spool.
Figure 3C:
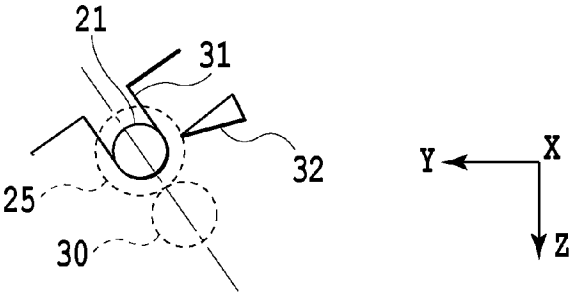
FIG. 3C is a view illustrating a set state of the spool.

FIGS. 3A, 3B, and 3C are views illustrating procedures for setting the sheet roll R at the supplying apparatus 200 by the use of the spool member 2. The spool member 2 includes a spool shaft 21, friction members 22, a spool flange 23 on a reference side, a spool flange 24 on a non-reference side, and a spool gear 25. The spool flange 23 on the reference side is attached to one end of the spool shaft 21 whereas the spool gear 25 for rotating the spool shaft 21 is fixed to the other end of the spool shaft 21. The friction members 22 are provided inside of the spool flange 23 on the reference side and the spool flange 24 on the non-reference side, respectively.

In setting the spool member 2 at the sheet roll R, first, the spool flange 24 on the non-reference side fitted to the spool shaft 21 is detached, and then, the spool shaft 21 is inserted into the hollow hole of the sheet roll R. Since the outer diameter of the spool shaft 21 is smaller than the inner diameter of the hollow hole of the sheet roll R, a clearance is defined therebetween. Therefore, a user can insert the spool shaft 21 into the hollow hole by a slight force. At the time when the right end of the sheet roll R in FIG. 3A is brought into contact with the spool flange 23 on the reference side, the friction member 22 inside of the spool flange 23 on the reference side is inserted into the hollow hole of the sheet roll R. In this manner, the spool flange 23 on the reference side is fixed to the sheet roll R. Thereafter, the spool flange 24 on the non-reference side is fitted to the spool shaft 21, and then, the friction member 22 inside of the spool flange 24 on the non-reference side is inserted into the hollow hole of the sheet roll R. As a consequence, the spool flange 24 on the non-reference side is fixed to the sheet roll R.

In this manner, the sheet roll R is fitted to the spool member 2, as shown in FIG. 3B. Thereafter, as shown in FIG. 3C, both ends of the spool member 2 are inserted into spool holders 31 at the supplying apparatus 200, thus completing the setting of the sheet roll R.

The spool holders 31 are disposed at positions corresponding to both ends of the spool shaft 21. The inner surface of each of the spool holders 31 is formed into a U shape. The end of the spool shaft 21 can be inserted through an opening formed at the spool holder 31. In a state in which the spool member 2 is inserted into the spool holders 31, the spool gear 25 is connected to a roll driving motor, described later, via a drive gear 30 on the side of the supplying apparatus 200. The roll driving motor drives the sheet roll R together with the spool member 2 forward and reversely, thereby supplying and winding the sheet 1. A roll sensor 32 is adapted to detect the sheet roll R.

Figure 4A:
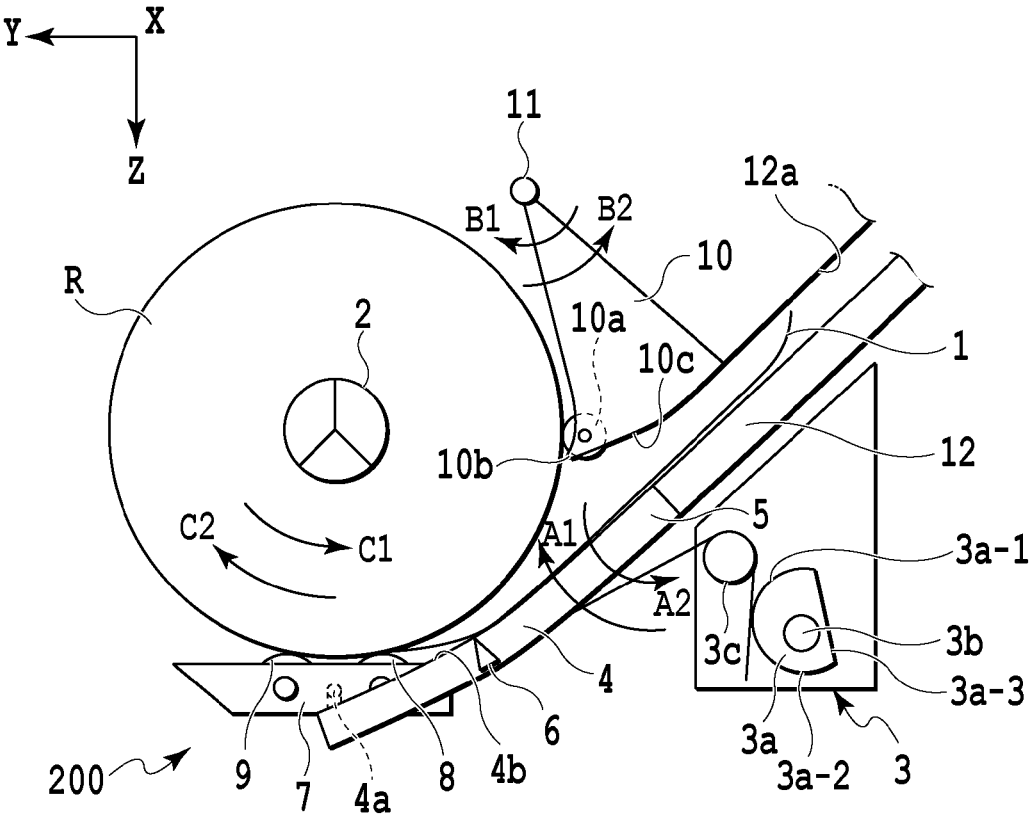
FIG. 4A is a view illustrating the sheet supplying apparatus and FIG. 4B is an enlarged view showing an equalizing mechanism in the sheet supplying apparatus.

FIGS. 4A, 4B, 5A, and 5B are views illustrating the supplying apparatus 200. The outer diameter of the sheet roll R in FIG. 4A is relatively large.

The arm member (i.e., the moving member) 4 is attached to the conveyance guide 12 via the turning shaft 5 in a manner turnable in directions indicated by arrows A1 and A2. At the upper portion of the arm member 4 is formed a guide 4*b* (i.e., a lower side guide member) for guiding the lower surface of the sheet 1 drawn out of the sheet roll R. A torsion coil spring 3*c* for pressing the arm member 4 in the direction indicated by the arrow A1 is interposed between the arm member 4 and a rotary cam 3*a* of the drive unit 3. The rotary cam 3*a* is rotated by a pressurizing/driving motor 34, described later, thereby varying force of the torsion coil spring 3*c* for pressing the arm member 4 in the direction indicated by the arrow A1. In a case where a relatively large diameter portion 3*a*-1 of the rotary cam 3*a* is brought into contact with the torsion coil spring 3*c*, the pressing force becomes large to generate "pressing force for strong nip," described later. In contrast, in a case where a relatively small diameter portion 3*a*-2 of the rotary cam 3*a* is brought into contact with the torsion coil spring 3*c*, the pressing force becomes small to generate "pressing force for weak nip," described later. Furthermore, in a case where a flat portion 3*a*-3 of the rotary cam 3*a* is brought into contact with the torsion coil spring 3*c*, the pressing force for pressing the arm member 4 in the direction indicated by the arrow A1 is released, so that first and second driven rollers (rotators), described later, are separated from the sheet roll R.

The supplying apparatus 200 is configured in such a manner as to be freely switched among three stages: the state in which the arm member 4 is pressed by a predetermined "pressing force for weak nip"; the state in which the arm member 4 is pressed by a predetermined "pressing force for strong nip"; and the state in which the pressing force for the arm member 4 is released.

The oscillating member 7 is oscillatably attached to the arm member 4. First and second driven rollers (i.e., pressing unit) 8 and 9 shifted in the circumferential direction of the sheet roll R are rotatably attached to the oscillating member 7. The first and second driven rollers 8 and 9 are brought into press-contact with the outer periphery of the sheet roll R from below, with respect to the direction of gravity, by the pressing force against the arm member 4 in the direction indicated by the arrow A1. In other words, the first and second driven rollers 8 and 9 are brought into press-contact with the outer periphery of the sheet roll R from below the center axis in the horizontal direction of the sheet roll R with respect to the direction of gravity. The press-contact force is varied according to the pressing force for pressing the arm member 4 in the direction indicated by the arrow A1. As a consequence, the drive unit 3 functions as a pressing mechanism for pressing the arm member 4. The drive unit 3 also functions as a moving mechanism for moving the arm member 4 in such a manner as to separate the first and second driven rollers 8 and 9 from the outer periphery of the sheet roll R.

Figure 4B:
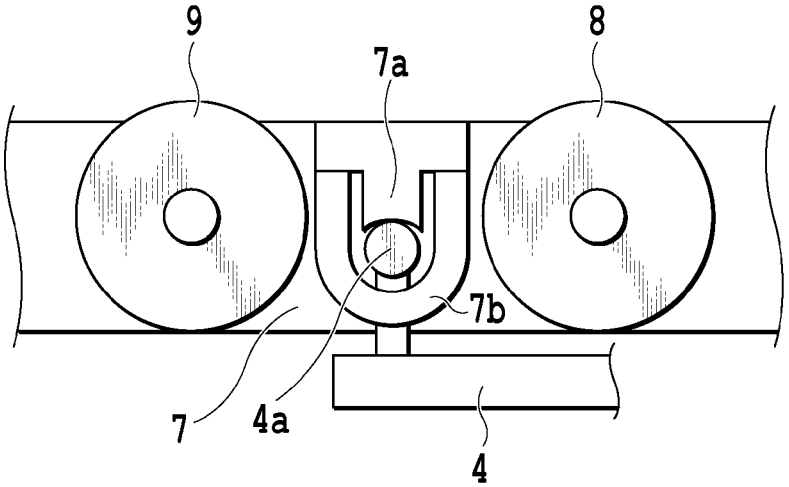
Figure 5A:
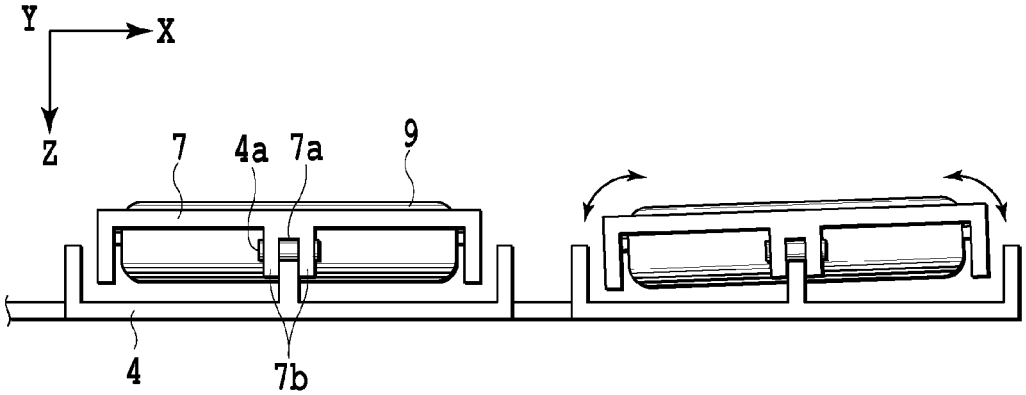
FIG. 5A is a side view showing the equalizing mechanism and FIG. 5B is a plan view showing the equalizing mechanism.
Figure 5B:
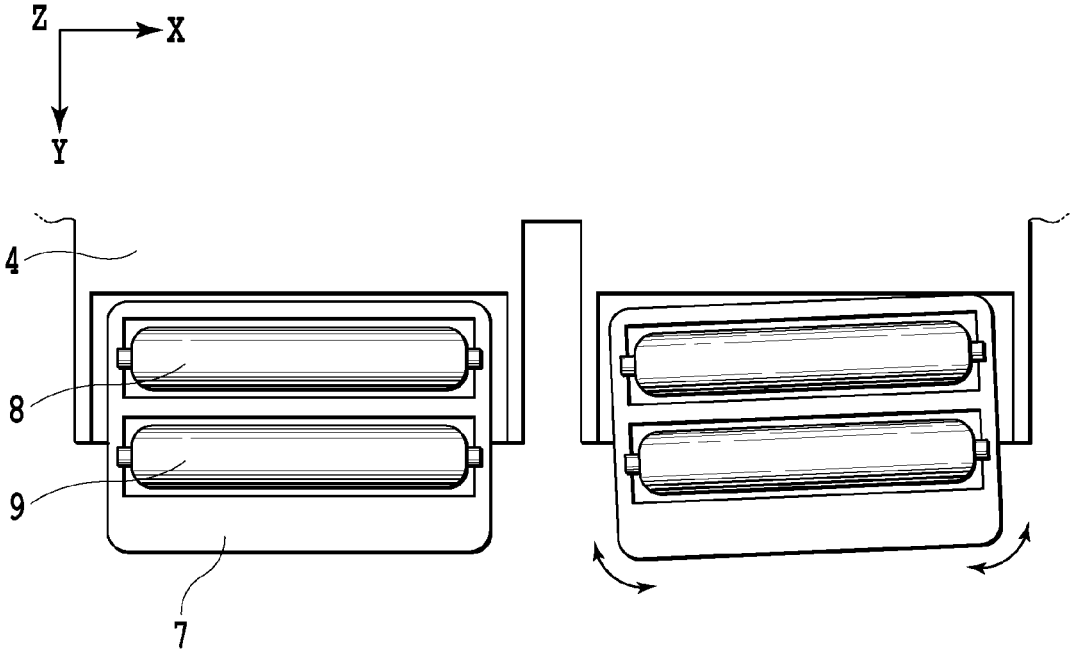

As shown in FIGS. 5A and 5B, the plurality of oscillating members 7 are attached to the arm member 4 in such a manner as to be arranged in a widthwise direction (i.e., an X-axial direction) of the sheet roll R. As shown in FIGS. 4B and 5A, the oscillating member 7 includes a shaft receiver 7*a* and shaft stoppers 7*b* that receive a rotary shaft 4*a* of the arm member 4 with a predetermined play. The shaft receiver 7*a* is brought into contact with the upper portion of the rotary shaft 4*a*. In contrast, the shaft stoppers 7*b* are positioned on both sides of the rotary shaft 4*a*, as shown in FIG. 5A, to thus face the lower portion and the front and rear portions (i.e., right and left portions in FIG. 4B) of the rotary shaft 4*a* with predetermined clearances. In this manner, the shaft stopper 7*b* restricts the range of the play of the rotary shaft 4*a*, and furthermore, stops the slippage of the rotary shaft 4*a*. In a case where the rotary shaft 4*a* is received between the shaft receiver 7*a* and the shaft stoppers 7*b*, at least one of the shaft stoppers 7*b* is temporarily elastically deformed such that an interval between the right and left shaft stoppers 7*b* in FIG. 5A is enlarged laterally in FIG. 5A. That is to say, the rotary shaft 4*a* is received through between the shaft stoppers 7*b* enlarged in the lateral direction. After the rotary shaft 4*a* is received in the above-described manner, the shaft stoppers 7*b* are elastically restored, thereby stopping the rotary shaft 4*a* from slipping, as shown in FIGS. 4B and 5A. The shaft stopper 7*b* may be made of an elastically deformable resin material.

The shaft receiver 7*a* is disposed at a position below, with respect to the direction of gravity, the oscillating member 7, and thus, is supported by the rotary shaft 4*a* in such a manner that the oscillating member 7 takes a stable posture in each of X-, Y-, and Z-axial directions. Specifically, like the left oscillating member 7 in FIGS. 5A and 5B, the oscillating member 7 is supported at its stable posture in each of the X-, Y-, and Z-axial directions. Moreover, since the rotary shaft 4*a* is received with a play, the oscillating member 7 is equalized along the outer periphery of the sheet roll R by the pressing force in the direction indicated by the arrow A1 against the arm member 4, like the right oscillating member 7 in FIGS. 5A and 5B. This configuration (i.e., an equalizing mechanism) allows the variation of the press-contact posture of the first and second driven rollers 8 and 9 with respect to the outer periphery of the sheet roll R. Consequently, a contact area in which the sheet 1 and the first and second driven rollers 8 and 9 are brought into contact with each other is always kept to be the largest, and furthermore, the pressing force with respect to the sheet 1 is equalized, thus suppressing variations of the conveyance force for the sheet 1 is suppressed. The first and second driven rollers 8 and 9 are brought into press-contact with the outer periphery of the sheet roll R, thus suppressing the generation of sag on the sheet 1 and thereby increasing its conveyance force. The first driven roller 8 mainly contributes to an increase in conveyance force for the sheet 1: in contrast, the second driven roller 9 mainly contributes to suppression of the generation of sag on the sheet 1.

The rotary shaft 4*a* has a circular cross section and extends in the X-axial direction. The shaft receiver 7*a* has a groove having U-shaped cross section and extends in the X-axial direction. The upper portion of the former rotary shaft 4*a* is stably fitted to the groove in the latter, so that the oscillating member 7 takes a stable posture, like the left oscillating member 7 shown in FIGS. 5A and 5B. Force for restoring the stable posture acts on the oscillating member 7. The above-described equalizing mechanism is not limited to the configuration in this embodiment. Any equalizing mechanisms may be used as long as variations in press-contact posture of the first and second driven rollers 8 and 9 with respect to the outer periphery of the sheet roll R are allowed.

Although the equalizing mechanism is disposed at a connecting portion between the oscillating member 7 and the arm member 4 in the present embodiment, an equalizing mechanism may be disposed at a connecting portion between the arm member 4 and the conveyance guide 12. Moreover, the plurality of oscillating members 7 are arranged at intervals in the widthwise direction of the sheet 1 in the present embodiment. In a case where the position of the spool flange 24 on the non-reference side with reference to the spool flange 23 on the reference side is varied according to the width of the sheet 1, the spool flange 24 on the non-reference side may be located between the adjacent oscillating members 7. In this manner, it is possible to avoid any interference between the oscillating member 7 and the spool flange 24 on the non-reference side.

To the main body of the printing apparatus 100 (i.e., a printer body) is swingably attached with the separating flapper 10 positioned upward of the arm member 4 on the swing shaft 11 in directions indicated by arrows B1 and B2. The separating flapper 10 is configured such that the sheet roll R is slightly pressed by its own weight. In a case where the sheet roll R need be more strongly pressed, an urging force by an urging member such as a spring may be used. A driven roller 10*a* is rotatably provided at a contact portion between the separating flapper 10 and the sheet roll R so as to suppress an influence on the sheet 1 by the pressing force. Moreover, a separator 10*b* at the tip of the separating flapper 10 is formed in such a manner as to extend up to a position as close to the surface of the sheet roll R as possible in order to facilitate the separation of the tip of the sheet from the sheet roll R.

The sheet 1 is drawn out of the sheet roll R through above the driven rollers 8 and 9, the lower surface of the sheet 1 is guided by the guide 4*b* at the upper portion of the arm member 4, and then, the sheet 1 is supplied through a supply path formed between the separating flapper 10 and the arm member 4. In this manner, the driven rollers 8 and 9 are brought into press-contact with the outer periphery of the sheet roll R from under, and then, the lower surface of the sheet 1 drawn through above the driven rollers 8 and 9 is guided by the guide 4*b*. Consequently, the sheet 1 can be smoothly supplied by utilizing its own weight. Additionally, the driven rollers 8 and 9 and the guide 4*b* are moved according to the outer diameter of the sheet roll R, so that the sheet 1 can be securely drawn out of the sheet roll R to be conveyed irrespectively of the size of the outer diameter of the sheet roll R.

The sheet 1 drawn out of the sheet roll R passes under a lower surface 10*c* of the separating flapper 10, and then, passes under a lower surface 12*a* of the conveyance guide 12. The lower surface 12*a* of the conveyance guide 12 is formed into a shape in conformity with a virtual circle on the swing shaft 11, so that a supply path without any step between the lower surface 10*c* and the lower surface 12*a* can be formed irrespective of the swing position of the separating flapper 10 in the directions indicated by the arrows B1 and B2. In this manner, the tip of the sheet 1 cannot be stuck on the supply path. The lower surface 10*c* of the separating flapper 10 is formed into a curved shape in conformity with the virtual circle on the swing shaft 11.

It is desirable that the first sheet sensor 6 provided on the arm member 4 should be located at a position slightly shifted downstream in the conveyance direction of the sheet 1 from the nip position between the sheet roll R and the driven roller 8. In the present embodiment, the two supplying apparatuses 200 are provided in a vertical direction. Therefore, the state in which the sheet 1 is supplied from one of the supplying apparatuses 200 can be switched to the state in which the sheet 1 is supplied from the other supplying apparatus 200. In this case, one of the supplying apparatuses 200 rewinds the sheet 1, which has been supplied so far, around the sheet roll R, and then, retracts the tip of the sheet 1 up to a position at which the sheet sensor 6 detects the tip of the sheet 1. In a case where the sheet sensor 6 is largely shifted downstream in the conveyance direction more than the present embodiment, the tip of the sheet 1 suspends into a clearance defined between the driven roller 8 and the arm member 4 by its own weight, thereby inducing an inconvenience of an adverse influence on the nip state of the sheet 1. Like the present embodiment, the sheet sensor 6 is disposed near the nip position between the sheet roll R and the driven roller 8, thus suppressing the generation of suspension by its own weight, so as to hardly mark a nip scar on the sheet 1.

Figure 6:
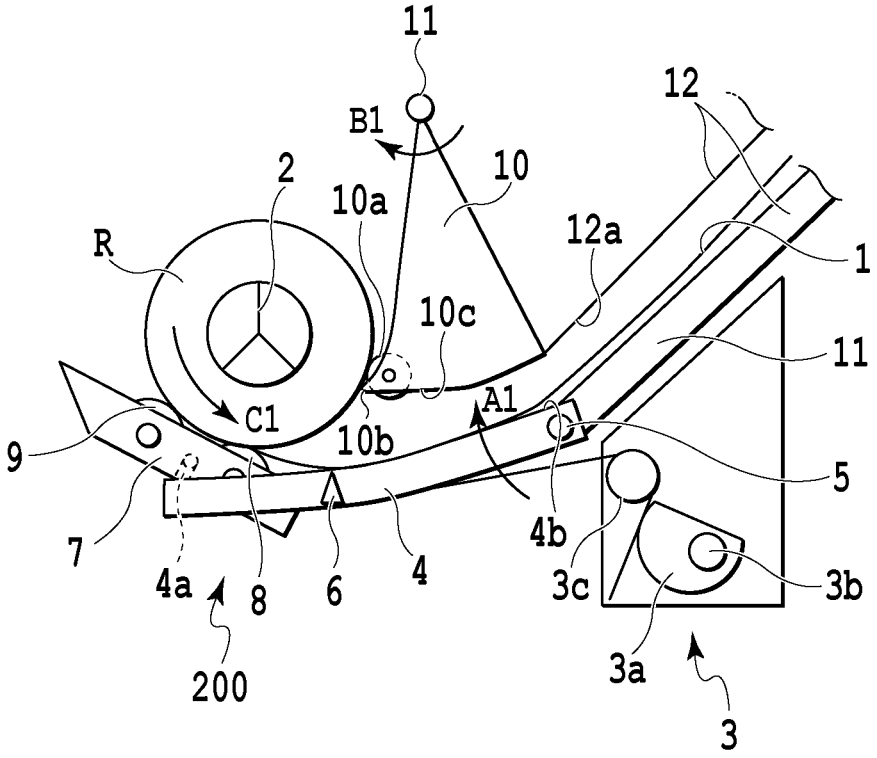
FIG. 6 is a view illustrating the sheet supplying apparatus in the case of a small outer diameter of a roll.

FIG. 6 is a view illustrating the supplying apparatus 200 in the case of a relatively small outer diameter of the sheet roll R.

Since the arm member 4 is pressed all the time in the direction indicated by the arrow A1 by the torsion coil spring 3*c*, the arm member 4 is turned in the direction indicated by the arrow A1 according to a decrease in outer diameter of the sheet roll R. Since the separating flapper 10 also is pressed all the time in the direction indicated by the arrow B1, the separating flapper 10 is swung in the direction indicated by the arrow B1 according to a decrease in outer diameter of the sheet roll R. Consequently, the separating flapper 10 forms the supply path between the conveyance guide 12 and the same even in a case where the outer diameter of the sheet roll R is decreased, thus guiding the upper surface of the sheet 1 by the lower surface 10*c*. In this manner, the arm member 4 is turned and the separating flapper 10 is swung according to a change in outer diameter of the sheet roll R, so that a substantially constant supply path is formed between the arm member 4 and the separating flapper 10 irrespective of the size of the outer diameter of the roll. As a consequence, even a sheet 1 having a low rigidity can be securely supplied without any buckling.

Figure 7:
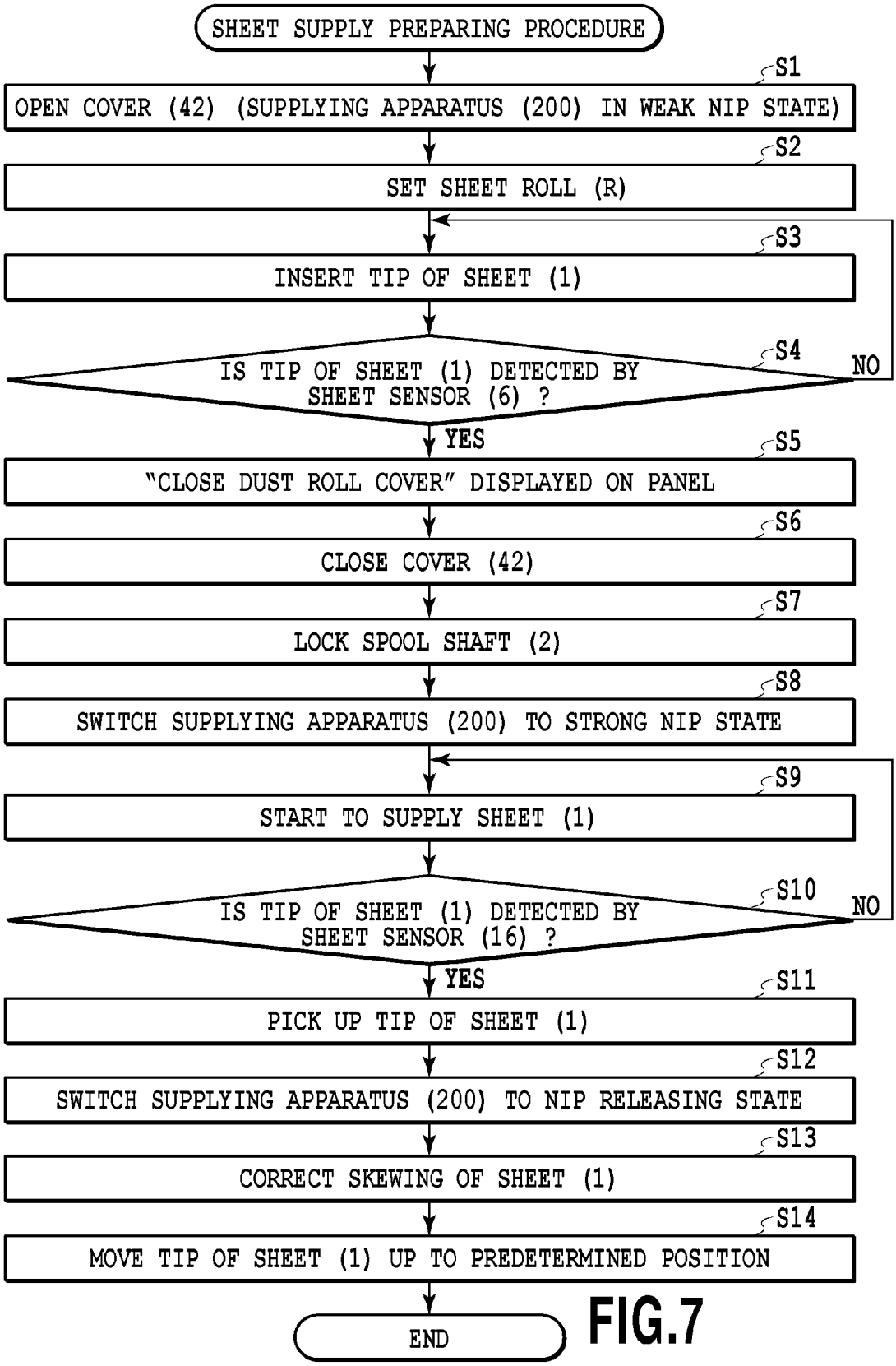
FIG. 7 is a flowchart illustrating a sheet supply preparing operation.

FIG. 7 is a flowchart illustrating sheet supply preparing procedures after setting of the sheet roll R.

First of all, the cover (i.e., a dust roll cover) 42 (see FIG. 2) of the sheet roll R is opened (step S1). At this time, the supplying apparatus 200 stands by in the state in which the arm member 4 is pressed by the "pressing force for weak nip" in the direction indicated by the arrow A1 (a weak nip state). Next, the spool member 2 is attached to the sheet roll R, as shown in FIGS. 3A and 3B, and then, the sheet roll R is set at the supplying apparatus 200 (step S2), as shown in FIG. 3C. The roll sensor 32 detects the setting of the sheet roll R.

A user sets the sheet roll R in this manner, and then, manually rotates the sheet roll R in the direction indicated by the arrow C2 to eliminate the sag of the sheet 1. Thereafter, the user manually rotates at least either one of the spool flanges 23 and 24 in the direction indicated by the arrow C1. In this manner, the tip of the sheet 1 is inserted into a sheet supply port defined between the arm member 4 and the separating flapper 10 (step S3). Upon the detection of the tip of the sheet 1 by the first sheet sensor 6, a CPU, described later, in the printing apparatus 100 displays a message of "close dust roll cover" on a display of the operation panel 28 (see FIG. 1) (steps S4 and S5). In a case where the user closes the cover 42 in response to the message (step S6), the CPU locks the spool shaft 21 by a lock mechanism, not shown, in such a manner as to prevent the spool shaft 21 from floating from the spool holder 31 (step S7). Thereafter, the CPU switches the supplying apparatus 200 from the weak nip state to a state in which the supplying apparatus 200 presses the arm member 4 in the direction indicated by the arrow A1 by the "pressing force for strong nip" (a strong nip state) (step S8).

After that, the CPU rotates the sheet roll R in the direction indicated by the arrow C1 by the roll driving motor, described later, thereby starting the supply of the sheet 1 (step S9). Upon the detection of the tip of the sheet 1 by the second sheet sensor 16 (step S10), the CPU rotates the conveyance roller 14 forward in the direction indicated by the arrow D1, thereby picking up the tip of the sheet 1 (step S11). Upon completion of the picking-up, the CPU releases the pressing force for pressing the arm member 4 at the supplying apparatus 200 in the direction indicated by the arrow A1, thus separating the first and second driven rollers 8 and 9 from the sheet roll R (a nip releasing state) (step S12).

Thereafter, the CPU detects the skewing of the sheet 1 conveyed inside of the sheet conveying apparatus 300. Specifically, the sheet 1 is conveyed inside of the sheet conveying apparatus 300 by a predetermined amount, and a sensor or the like provided for the sheet conveying apparatus 300 detects the skewing amount generated at this time. In a case where the skewing amount is larger than an allowable amount, the sheet 1 is repeatedly fed forward and backward according to the forward and reverse rotation of the conveyance roller 14 and sheet roll R. This operation corrects the skewing of the sheet 1 (step S13). In this manner, in correcting the skewing of the sheet 1 and printing an image on the sheet 1, the supplying apparatus 200 is released from the nip, thereby avoiding any adverse influence on the correction accuracy of the skewing of the sheet 1 and the print accuracy of an image by the driven rollers 8 and 9. And then, the CPU moves the tip of the sheet 1 up to a standby position (i.e., a predetermined position) at the print unit 400 inside by the sheet conveying unit 300 (step S14) before the start of a printing operation. In this manner, the supply preparation of the sheet 1 is completed. Thereafter, the sheet 1 is drawn out of the sheet roll R according to the rotation of the sheet roll R, to be thus conveyed to the print unit 400 by the sheet conveying unit 300.

Figure 8:
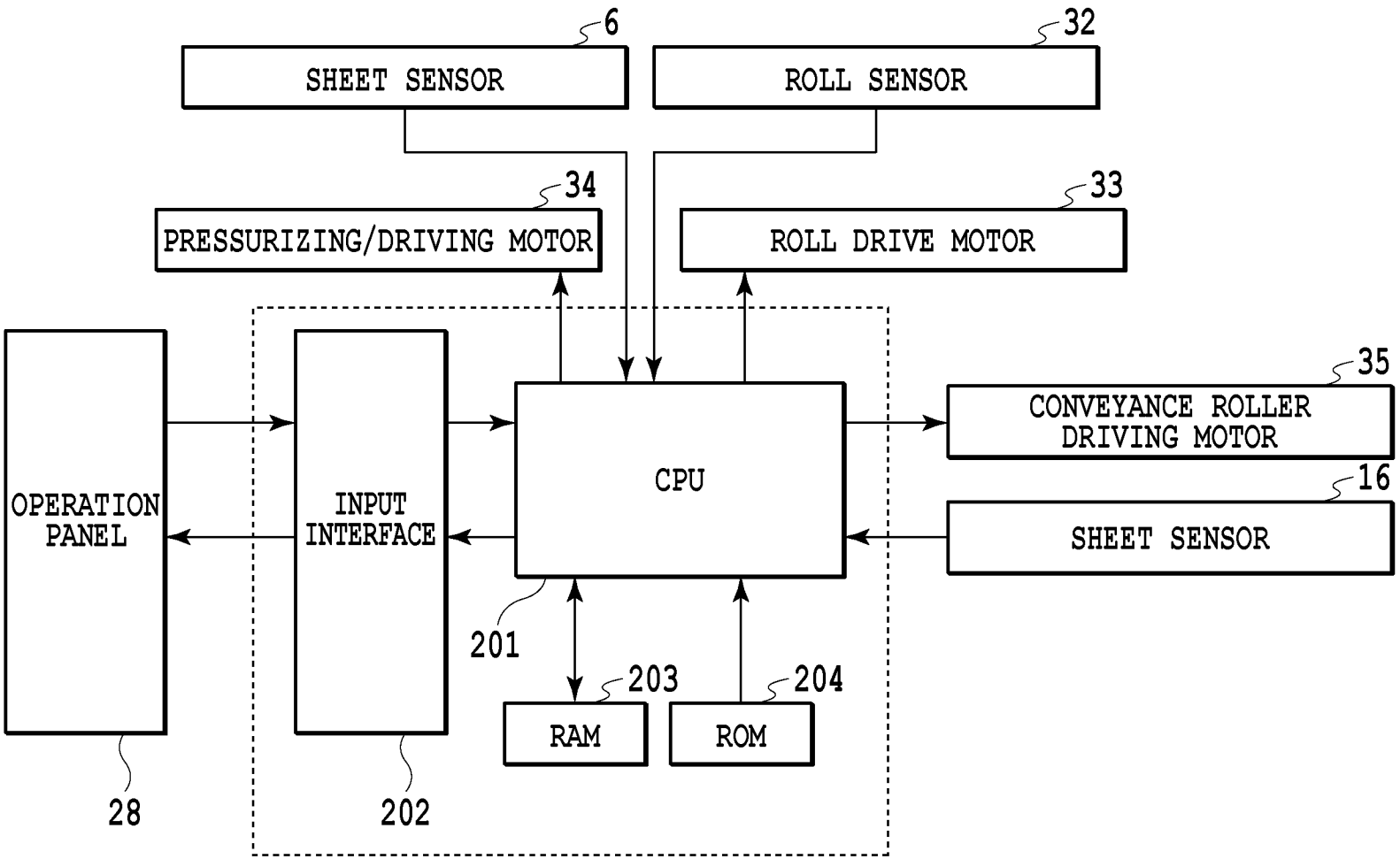
FIG. 8 is a block diagram illustrating a control system of the printing apparatus.

FIG. 8 is a block diagram illustrating a constitutional example of a control system in the printing apparatus 100. A CPU 201 controls each part of the printing apparatus 100 including the supplying apparatus 200, the sheet conveying unit 300, and the print unit 400 in accordance with a control program stored in a ROM 204. The CPU 201 receives the type and width of sheet 1 and various setting information from the operation panel 28 via an input interface 202. Moreover, the CPU 201 writes and reads information about the sheet 1 in and from a RAM 203. A roll driving motor 33 is adapted to rotate the sheet roll R forward and reversely, and configures a drive mechanism (i.e., a rotary mechanism) capable of rotating the sheet roll R. A pressurizing/driving motor 34 is designed to rotate the rotary cam 3*a* for adjusting the pressing force against the arm member 4. A conveyance roller driving motor 35 is adapted to rotate the conveyance roller 14 forward and reversely.

In a case where the sheet roll R set at the supply apparatus 200 is detected by the roll sensor 32, after the tip of the sheet 1 is detected by the first sheet sensor 6, the CPU 201 receives set completion information. Consequently, the CPU 201 issues a rotation command for the pressurizing/driving motor 34, to thus rotate it, thereby adjusting the pressing force against the arm member 4. Thereafter, the CPU 201 allows the roll driving motor 33 to rotate the sheet roll R forward in the direction indicated by the arrow C1, thus feeding the sheet 1. After that, the CPU 201 allows the conveyance roller driving motor 35 to rotate the conveyance roller 14 forward in the direction indicated by the arrow D1 in a case where the second sheet sensor 16 detects the tip of the sheet 1, thus conveying the sheet 1.

Second Embodiment

In the first embodiment, the supplying apparatus 200 is brought into the nip releasing state during the correction of skewing of the sheet 1 and the printing operation of an image on the sheet 1. In the present embodiment, a supplying apparatus 200 is brought into the nip releasing state also in a case where the sheet 1 cannot be automatically supplied. For example, in a case where the sheet 1 is of a type having a high conveyance resistance caused by strong curl due to a high rigidity, it is difficult to automatically supply the sheet 1, unlike the first embodiment.

Figure 9:
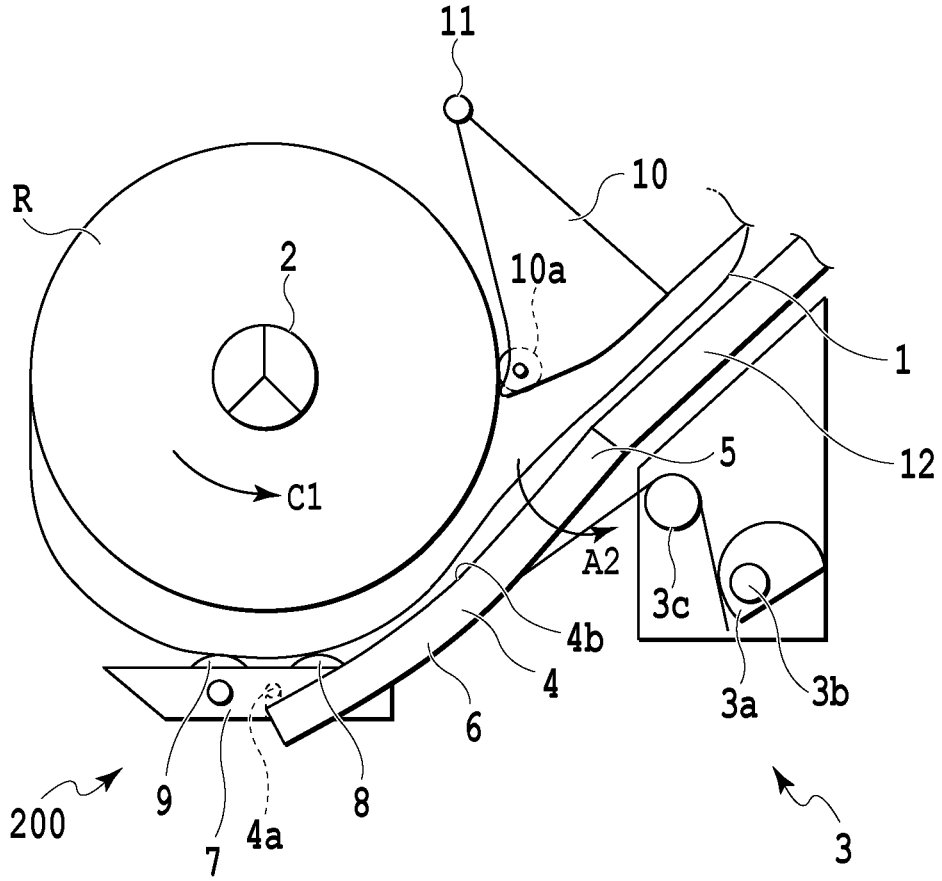
FIG. 9 is a view illustrating a sheet supplying apparatus in a second embodiment of the present invention.

In the present embodiment, first, as shown in FIG. 9, the supplying apparatus 200 is brought into the nip releasing state, and then, the driven rollers 8 and 9 are separated from the sheet roll R. And then, a user inserts the tip of the sheet 1 into a path guide formed on the arm member 4. Thereafter, the user puts his/her hand into a clearance defined between the supplying apparatus 200 and the sheet roll R or into the supplying apparatus 200, and rotates the sheet roll R in the direction indicated by the arrow C1, so as to feed the tip of the sheet 1 up to the conveyance roller 14. In this manner, the supply of the sheet 1 is completed. Thus, the number of types of usable sheets 1 is remarkably increased, so that the supplying apparatus 200 can cope with more types of sheets 1.

Third Embodiment

The first embodiment is configured such that the pressing force of the arm member 4 can be switched on three stages: the strong nip state, the weak nip state, and the releasing state in the supplying apparatus 200. The adjustment stages of the pressing force are not limited to three, and further, the pressing force may be adjusted on a continuously variable stage. In this case, the pressing force in the strong nip state is optimally set according to a conveyance resistance that depends upon the shape of a conveyance path of the sheet 1, the rigidity of the sheet 1, and the friction coefficient of the surface of the sheet 1. In setting the sheet roll R, the supplying apparatus 200 is brought into the weak nip state, as described above, and the lock mechanism for locking the spool shaft 21 in such a manner as not to float from the spool holder 31 is brought into an unlocked state. Therefore, the pressing force in the weak nip state is optimally set in such a manner as not to allow the spool shaft 21 to float even in the state in which only the paper core of the sheet roll R is set to the spool shaft 21.

For example, in the case of sheets that are capable of pressed by a high pressing force while being supplied, such as a high rigid sheet like a coated paper and a sheet having a high weighing capacity typified by canvas, the pressing force in the strong nip state is highly set. In this manner, the sheet is strongly conveyed, and thus, the sheet can be securely supplied. Specifically, the pressing force in the strong nip state is more highly set with respect to the sheet 1 that is hardly supplied, so that more types of sheets 1 can be automatically supplied. Alternatively, the sheet 1 that is hardly automatically supplied can be manually supplied, like in the second embodiment.

Fourth Embodiment

Figure 10:
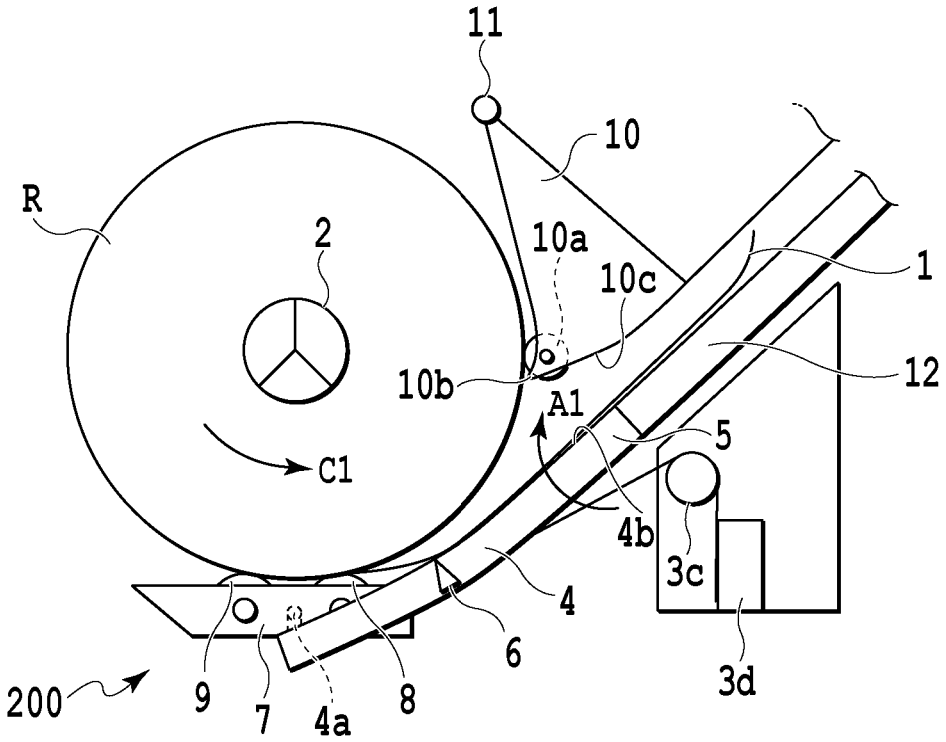
FIG. 10 is a view illustrating a sheet supplying apparatus in a fourth embodiment of the present invention.

A supplying apparatus 200 in the present embodiment is not provided with the rotary cam 3*a* at the drive unit 3 in the above-described embodiments, as shown in FIG. 10. However, the drive unit 3 includes the torsion coil spring 3*c* and a fixing portion 3*d* for fixing one end of the torsion coil spring 3*c*. As a consequence, the arm member 4 is pressed by a constant pressing force in the direction indicated by the arrow A1. The spring constant of the torsion coil spring 3*c* is optimally set so as to suppress a large change in pressing force of the arm member 4 caused by a change in outer diameter of the sheet roll R.

The type of sheet to be used may be limited according to a model of printing apparatus. Plain paper is mainly used in a CAD machine, for example. Since the plain paper has a low rigidity, its conveyance resistance is not so high. Therefore, even in the case of a configuration in which the pressing force of the arm member 4 is constant and a nip pressure cannot be changed, the plain paper can be supplied. In this manner, according to the type of sheet to be used in the printing apparatus, the configuration for changing the pressing force of the arm member 4 is omitted, thus simplifying the configuration of the supplying apparatus 200 and the printing apparatus 100 so as to reduce costs.

Fifth Embodiment

Figure 11:
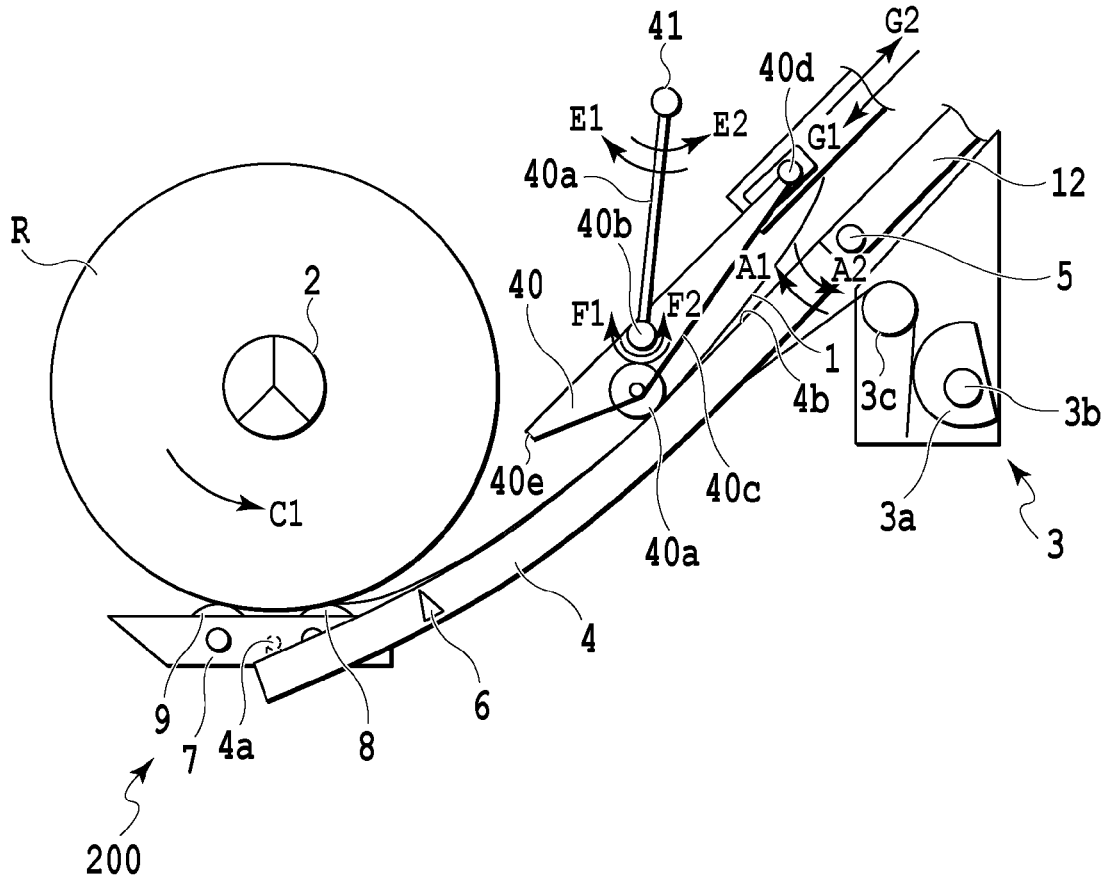
FIG. 11 is a view illustrating a sheet supplying apparatus in a fifth embodiment of the present invention in the case of a large outer diameter of a roll.
Figure 12:
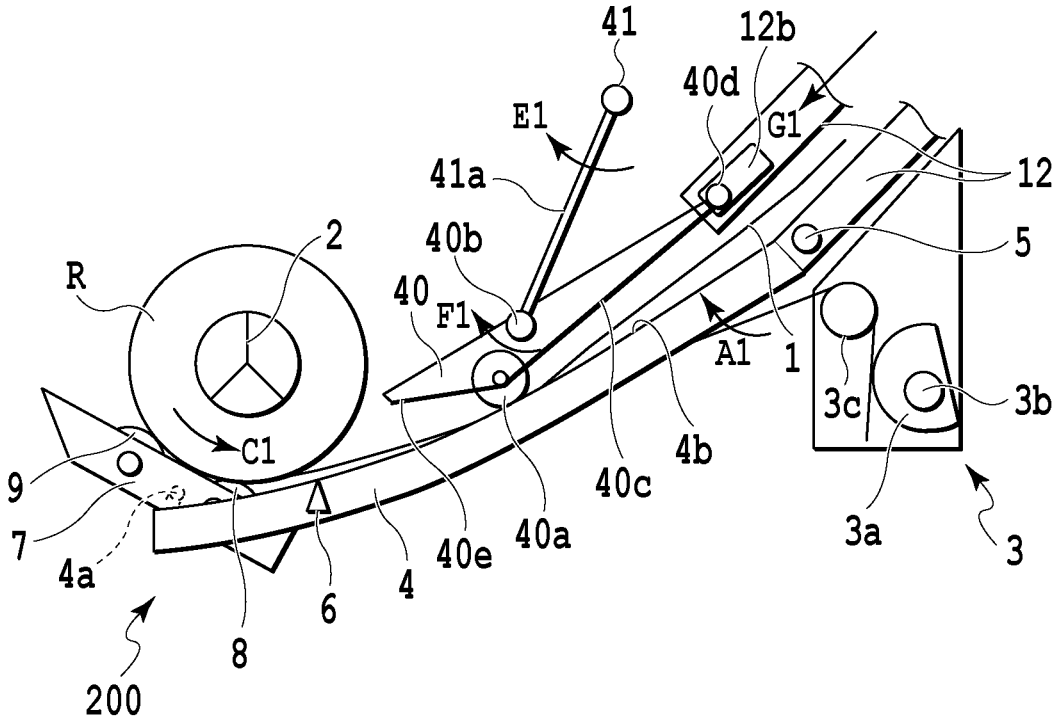
FIG. 12 is a view illustrating the sheet supplying apparatus in the fifth embodiment of the present invention in the case of a small outer diameter of a roll.

FIGS. 11 and 12 are views illustrating a fifth embodiment of the present invention.

A support arm 41*a* is supported on a rotary shaft 41 at a constant position in the supplying apparatus 200 in a manner turnable in directions indicated by arrows E1 and E2. A separating flapper 40 is supported on a flapper shaft 40*b* disposed at the support arm 41*a* in a manner swingable in directions indicated by arrows F1 and F2. The separating flapper 40 is pressed on the guide 4*b* of the arm member 4 in a movable manner by its own weight or a spring having a low load, not shown, via a slide member (i.e., a rotatable roller) 40*a*. The separating flapper 40 is provided with a restricting member 40*d* that is slidable in directions indicated by arrows G1 and G2 along a slot 12*b* formed at the conveyance guide 12. The restricting member 40*d* restricts the swing range of the separating flapper 40 on the flapper shaft 40*b* in the directions indicated by the arrows F1 and F2. In other words, in a case where the arm member 4 is located at one turn position in directions indicated by arrows A1 and A2, the posture of the separating flapper 40 located on the arm member 4 is restricted to one. Consequently, a supply path having a predetermined vertical width in FIGS. 11 and 12 can be formed between the guide 4*b* on the arm member 4 and a guide surface 40*c* of the separating flapper 40.

During the supplying operation of the sheet 1, the sheet 1 intrudes between the guide 4*b* of the arm member 4 and the slide member 40*a*. Therefore, the sheet 1 pushes up the separating flapper 40 by its thickness while being supplied through the supply path defined between the guide 4*b* of the arm member 4 and the guide surface 41*c* of the separating flapper 40. The supply path is formed in a predetermined width, as described above, thereby suppressing any buckling of the sheet such as a low rigidity sheet or a thin sheet.

The arm member 4 is pressed by the torsion coil spring 3*c* all the time in the direction indicated by the arrow A1. Consequently, as the outer diameter of the sheet roll R is reduced, as shown in FIG. 12, the arm member 4 is turned in the direction indicated by the arrow A1 according to the roll outer diameter. Moreover, the posture of the separating flapper 40 is changed in association with the arm member 4, so that the supply path having a predetermined width is defined between the guide surface 41*c* of the separating flapper 40 and the guide 4*b* of the arm member 4. As a consequence, it is possible to suppress any buckling of the sheet such as a low rigidity sheet or a thin sheet, like in the case of the large outer diameter of the sheet roll R, as shown in FIG. 11.

In a case where there is a large clearance between the sheet roll R and a tip end 40*e* of the separating flapper 40, in the case of, particularly, a sheet 1 having a large curl, the tip end of the sheet 1 is wound around the sheet roll R, whereby the sheet 1 possibly hardly intrudes into a sheet supply port between the arm member 4 and the separating flapper 40. In view of this, the small clearance between the sheet roll R and the tip end 40*e* of the separating flapper 40 is desired. In the present embodiment, as the outer diameter of the sheet roll R becomes smaller, the tip end 40*e* of the separating flapper 40 approaches the center of the sheet roll R according to the turn of the support arm 41*a*, the swing of the separating flapper 40, and the movement of the restricting member 40*d*, as shown in FIG. 12. Thus, irrespective of the size of the outer diameter of the sheet roll R, the clearance defined between the sheet roll R and the tip end 40*e* of the separating flapper 40 can be kept to be small, and further, the tip of the sheet 1 can be securely separated from the sheet roll R, to be thus introduced into the sheet supply port.

Sixth Embodiment

Figure 13:
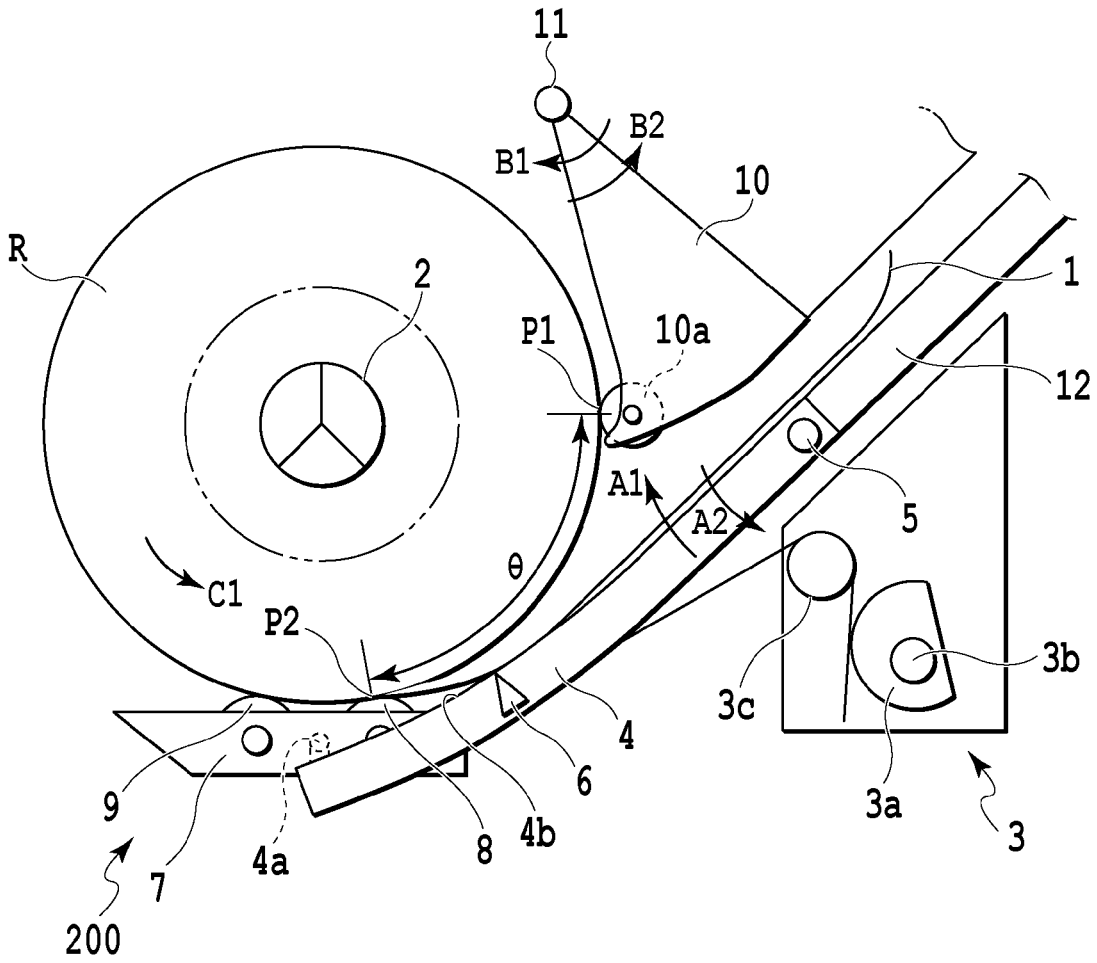
FIG. 13 is a view illustrating a sheet supplying apparatus in a sixth embodiment of the present invention in the case of a large outer diameter of a roll.
Figure 14:
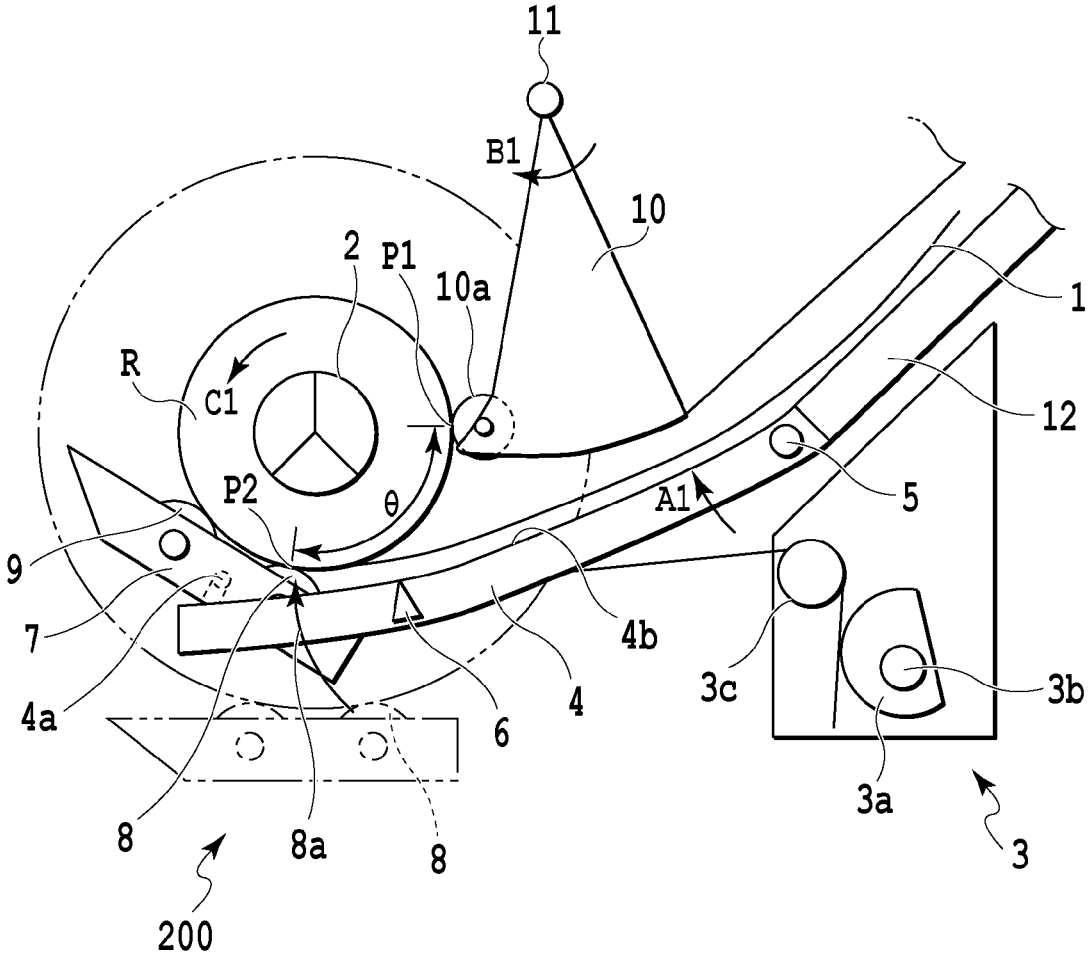
FIG. 14 is a view illustrating the sheet supplying apparatus in the sixth embodiment of the present invention in the case of a small outer diameter of a roll.

FIGS. 13 and 14 are views illustrating a sixth embodiment of the present invention.

The present embodiment is configured such that as the outer diameter of the sheet roll R changes from a large diameter shown in FIG. 13 to a small diameter shown in FIG. 14, the driven roller 8 moves while drawing a trace indicated by an arrow 8*a* in FIG. 14. In the state shown in FIG. 13, the driven roller 8 is located nearer the sheet supply port between the arm member 4 and the separating flapper 10 than a position vertically under the center of the sheet roll R. In this state, a contact position (i.e., a contact point) P1 of the driven roller 10*a* with respect to the sheet roll R and a contact position (i.e., a contact point) P2 of the driven roller 8 with respect to the sheet roll R are separated from each other by an angle θ in the rotational direction of the sheet roll R. In the state shown in FIG. 14, the driven roller 8 is located nearer the position vertically under the center of the sheet roll R than the sheet supply port. In other words, the driven roller 8 moves while drawing the trace indicated by the arrow 8*a* in such a manner as to increase the angle θ.

The curl of the sheet 1 becomes stronger as the outer diameter of the sheet roll R becomes smaller. However, the driven roller 8 moves as the outer diameter becomes smaller, and then, the supply direction of the sheet 1 along a tangent at the point P2 changes downward and rightward in FIG. 14. Therefore, the tip of the sheet 1 is easily separated from the sheet roll R. Furthermore, a distance between a position at which the sheet 1 is drawn out of the sheet roll R and a position at which the sheet 1 is brought into contact with the guide 4*b* of the arm member 4 becomes short, thus reducing an aerial conveyance range, at which the sheet 1 is not guided but conveyed. Consequently, it is possible to suppress any occurrence of buckling of a sheet having a low rigidity as well.

Seventh Embodiment

Figure 15:
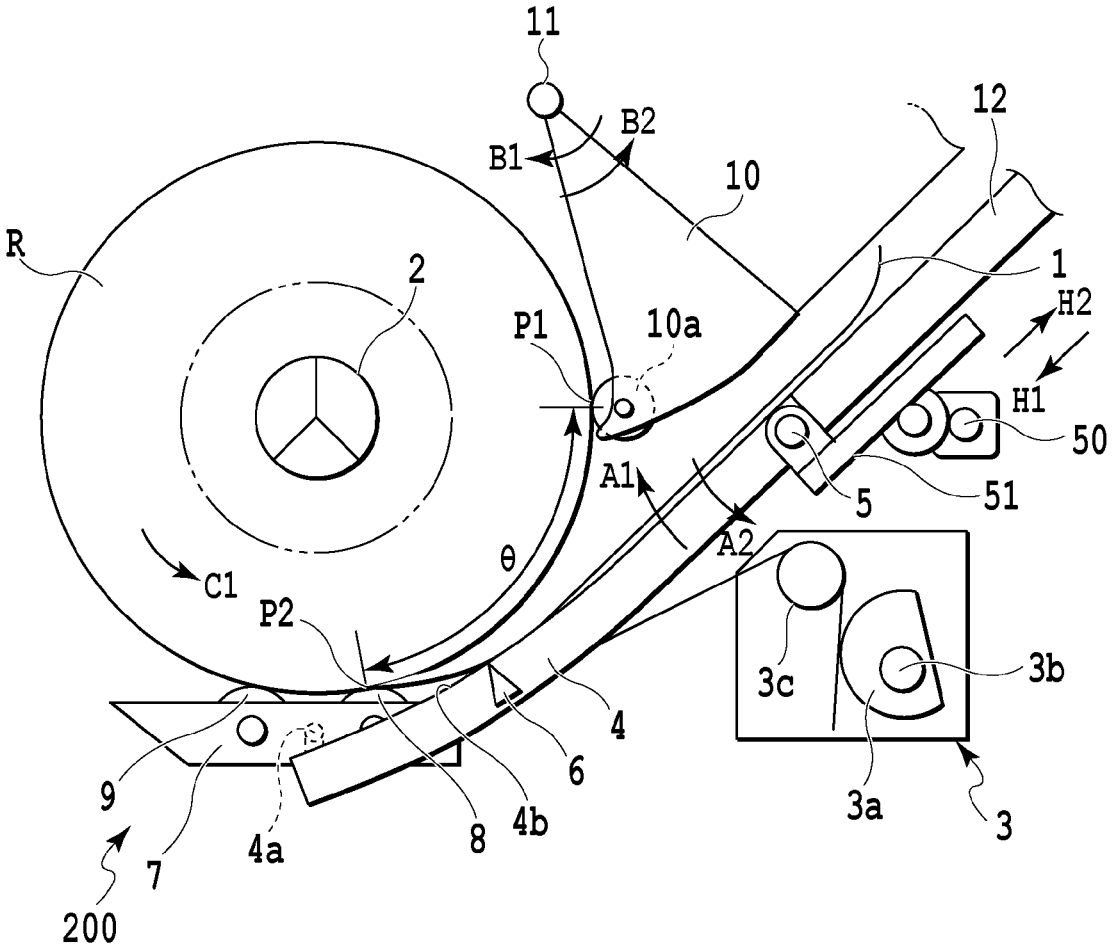
FIG. 15 is a view illustrating a sheet supplying apparatus in a seventh embodiment of the present invention in the case of a large outer diameter of a roll.
Figure 16:
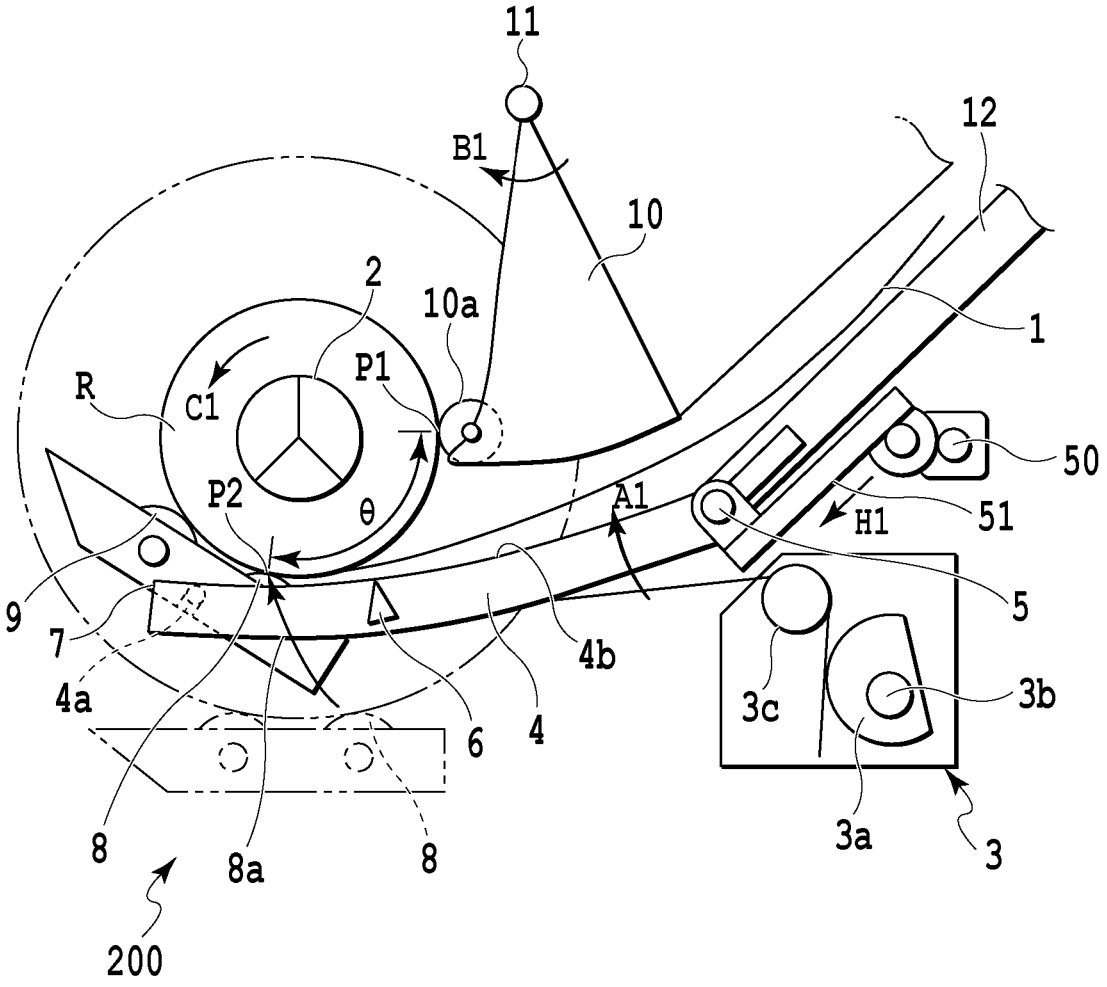
FIG. 16 is a view illustrating the sheet supplying apparatus in the seventh embodiment of the present invention in the case of a small outer diameter of a roll.

FIGS. 15 and 16 are views illustrating a seventh embodiment of the present invention. In the present embodiment, the supplying apparatus 200 in the sixth embodiment is additionally provided with a guide 51 for movably guiding the rotary shaft 5 of the arm member 4 in directions indicated by arrows H1 and H2 parallel to the conveyance direction of the sheet 1 and a drive unit 50 for moving the rotary shaft 5 in the directions indicated by the arrows H1 and H2. The drive unit 50 constitutes an adjusting mechanism capable of adjusting the position of the arm member 4 in such a manner as to shift the contact point P2 in the circumferential direction of the sheet roll R.

The drive unit 50 moves the rotary shaft 5 in the direction indicated by the arrow H1 reverse to the supply direction of the sheet 1 as the outer diameter of the sheet roll R becomes smaller. In this manner, as the roll outer diameter becomes smaller, the contact point P2 is shifted upstream in the supply direction along the circumference of the sheet roll R. Therefore, the supply direction of the sheet 1 along the tangent at the contact point P2 changes to be oriented downward and rightward in FIG. 16 farther than in the sixth embodiment. As a consequence, the tip of the sheet 1 is more easily separated from the sheet roll R. Moreover, the distance between the position at which the sheet 1 is drawn out of the sheet roll R and the position at which the sheet 1 is brought into contact with the guide 4*b* of the arm member 4 becomes shorter than that in the sixth embodiment. Thus, it is possible to reduce the aerial conveyance range, in which the sheet 1 is not guided but conveyed, thereby suppressing any occurrence of buckling of a sheet having a low rigidity. The drive unit 50 can adjust the position of the arm member 4 according to the type of sheet 1.

Eighth Embodiment

Figure 17:
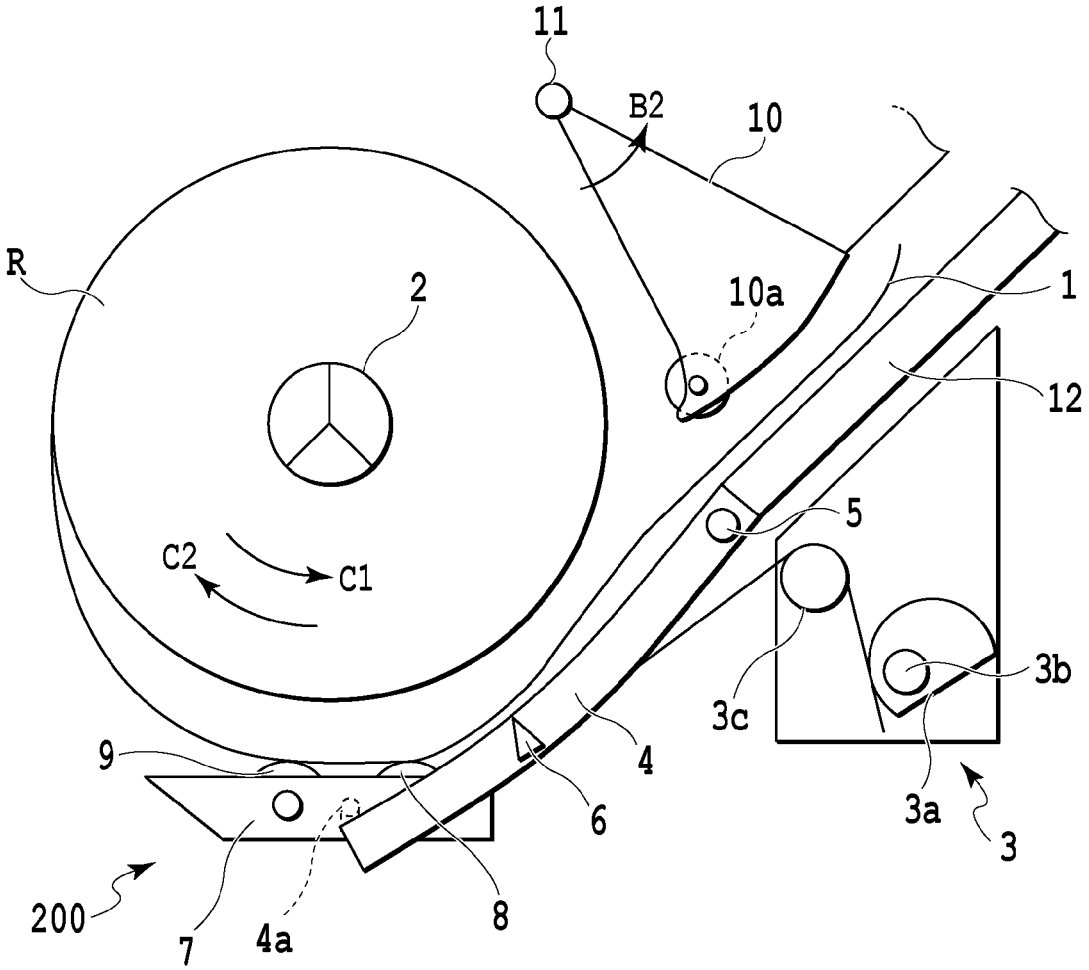
FIG. 17 is a view illustrating a sheet supplying apparatus in an eighth embodiment of the present invention.
Figure 18:
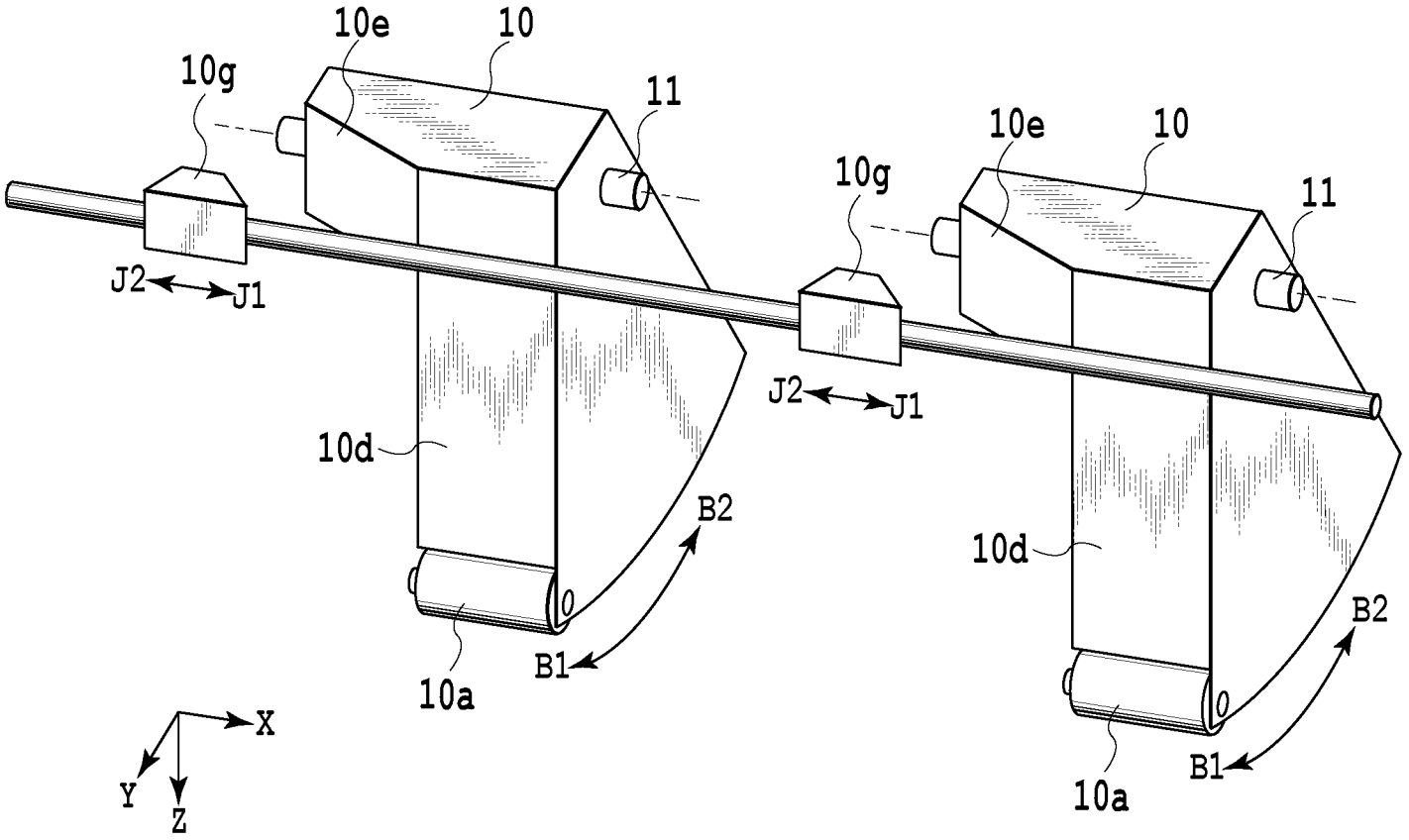
FIG. 18 is a view illustrating a swing mechanism for a separating flapper in FIG. 17.

FIGS. 17 and 18 are views illustrating essential parts of an eighth embodiment of the present invention.

In the present embodiment, as shown in FIG. 18, a plurality of separating flappers 10 are arranged in the widthwise direction of the sheet roll R. Since the plurality of separating flappers 10 are arranged, the function of separating the tip of the sheet 1 from the sheet roll R can be enhanced, and furthermore, sag of the sheet 1 can be prevented over the entire region of the sheet roll R in the widthwise direction in a case where the sheet 1 passes through the supply path. In this manner, the sheet can be more stably supplied.

As described above, the separating flapper 10 swings in the direction indicated by the arrow B1 by its own weight, and is slightly pressed against the sheet roll R via the driven roller 10*a*. Damage may be exerted on the sheet 1 due to the contact of the sheet 1 with the driven roller 10*a* depending on the type of sheet 1. In the case of, in particular, a sheet 1 that is liable to be scarred or recessed, the sheet 1 is susceptible to damage. In a case where damage is exerted on a side of the sheet 1, on which an image is printed, the image is possibly degraded. In view of this, in a case where a sheet 1 that is susceptible to damage is supplied, it is desirable that the separating flapper 10 should retract from the sheet roll R, as shown in FIG. 17. The plurality of separating flappers 10 arranged in the widthwise direction of the sheet roll R may be configured such that they independently move to contact positions at which they are brought into contact with the sheet roll R and retraction positions at which they retract from the sheet roll R. Alternatively, the separating flappers 10 may be associated with each other in such a manner as to move to the contact positions and the retraction positions at the same time.

In the present embodiment, the separating flappers 10 are associated with each other. In each of the separating flappers 10, a cam face 10*e* is formed at an arm 10*d* between the rotary shaft 11 and the driven roller 10*a*. A corresponding cam 10*g* acts on the cam face 10*e*. The cam 10*g* can slide in directions indicated by arrows J1 and J2 in the widthwise direction (i.e., an X-axial direction) of the sheet roll R. Upon abutment of the cam 10*g* on the cam face 10*e* caused by the slide of the cam 10*g* in the direction indicated by the arrow J1, the separating flapper 10 swings in the direction indicated by the arrow B2 against its own weight. In contrast, upon separation of the cam 10*g* from the cam face 10*e* caused by the slide of cam 10*g* in the direction indicated by the arrow J2, the separating flapper 10 is allowed to swing in the direction indicated by the arrow B1 by its own weight.

The cams 10*g* corresponding to the separating flappers 10 are connected to each other in such a manner as to slide in association with each other. When a user operates a lever, not shown, in one direction, all of the cams 10*g* slide at the same time in the direction indicated by the arrow J1 by the resultant operational force, thereby abutting on the corresponding cam faces 10*e*, respectively. As a consequence, as shown in FIG. 17, each of the separating flappers 10 swings in the direction indicated by the arrow B2, and then, is kept in a state separated from the sheet roll R. To the contrary, the user operates the lever in the other direction so that all of the cams 10*g* slide in the direction indicated by the arrow J2 by the resultant operational force, to be thus separated from the corresponding cam faces 10*e*, respectively. Consequently, each of the separating flappers 10 is allowed to swing in the direction indicated by the arrow B1, so that the driven roller 10*a* is brought into contact with the sheet roll R.

In the present embodiment, the user manually operates the lever, as required, so that the separating flapper 10 is separated from the sheet roll R, as shown in FIG. 17. However, the separating flapper 10 may be configured to be automatically separated from the sheet roll R by using a motor or the like based on the selection result of the type of sheet 1 to be used. The cam 10*g* is not limited to a slider cam that linearly slides as in the present embodiment, but it may be a rotary cam, for example. The cam 10*g* may be configured to be manually turned.

In a case where the driven roller 10*a* is kept to abut against the sheet roll R while the sheet roll R is accidentally rotated in the direction indicated by the arrow C1 in the state in which the tip of the sheet 1 has not yet been separated from the sheet roll R, the tip of the sheet 1 is forcibly separated from the sheet roll R. In this case, damage is possibly exerted on the sheet 1. For example, the sheet roll R is stored in the state in which the tip of the sheet 1 is taped to the outer periphery of the sheet roll R and at one portion of the center of the tip of the sheet 1 in the widthwise direction (or restrained by a raveling preventing band or the like). In a case where the sheet roll R is accidentally rotated in the direction indicated by the arrow C1 in the above-described storage state after the sheet roll R in the storage state is set at the printing apparatus, the sheet 1 is possibly torn. Specifically, the tip of the sheet 1 is forcibly separated from the sheet roll R within a range in which the sheet 1 is not fixed or restrained (in this case, both sides apart from the center in the widthwise direction), to be possibly torn.

In consideration of the above-described case, as shown in FIG. 17, the driven roller 10*a* of the separating flapper 10 is retracted from the sheet roll R in advance. In this manner, even in a case where the sheet roll R in the storage state is accidentally rotated, damage can be avoided from being exerted on the sheet 1. Incidentally, in a case where the sheet roll R in the storage state is set at the printing apparatus, the tape or the band that fixes or restrains the tip of the sheet 1 is detached, and then, the separating flapper 10 is swung in such a manner as to allow the driven roller 10*a* to abut against the sheet roll R. Thereafter, the sheet 1 starts to be fed in the same manner as in the above-described embodiments.

Ninth Embodiment

Figure 19:
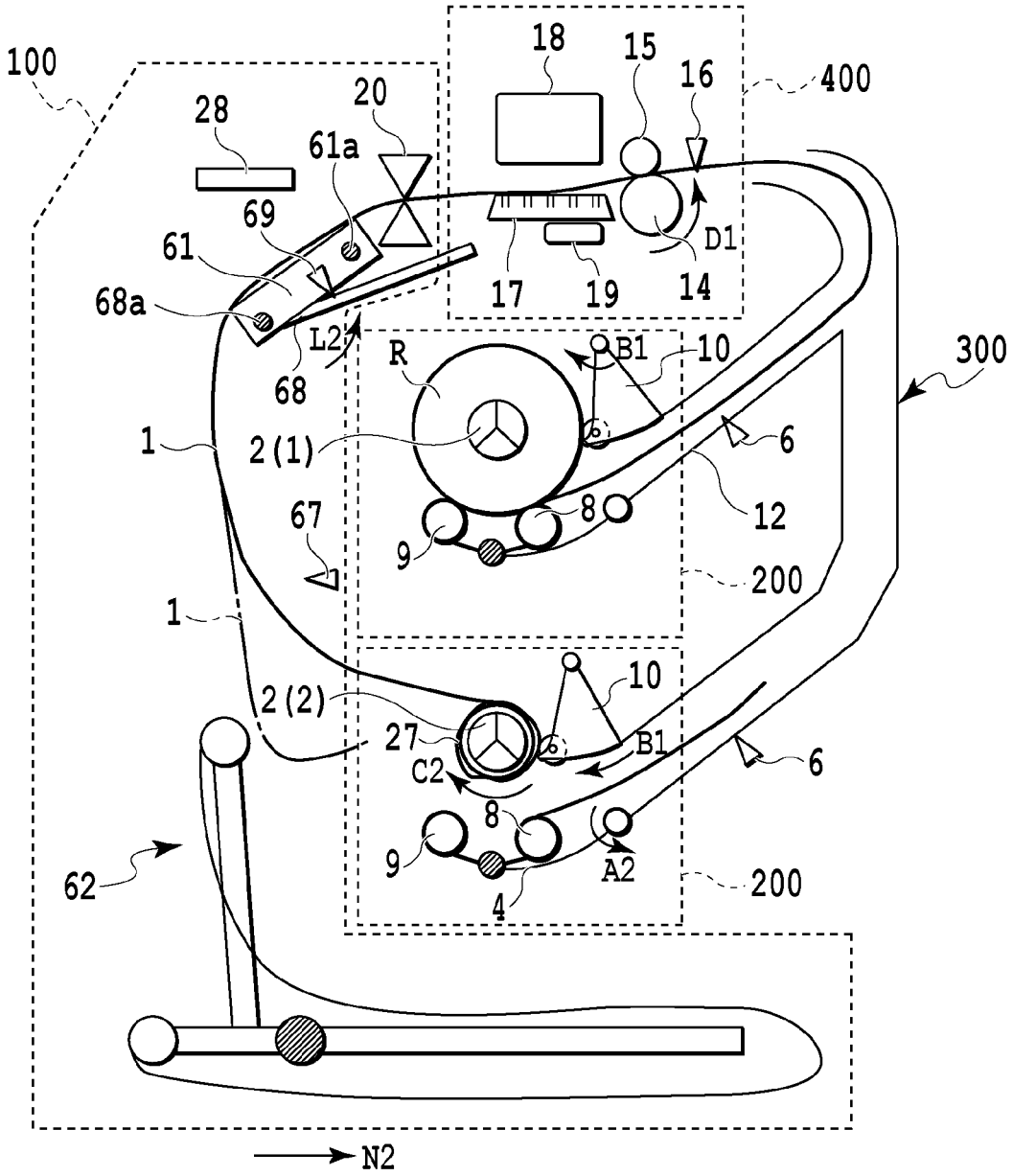
FIG. 19 is a view illustrating a printing apparatus in a ninth embodiment of the present invention, in which a sheet is set in an inward wound manner.
Figure 20:
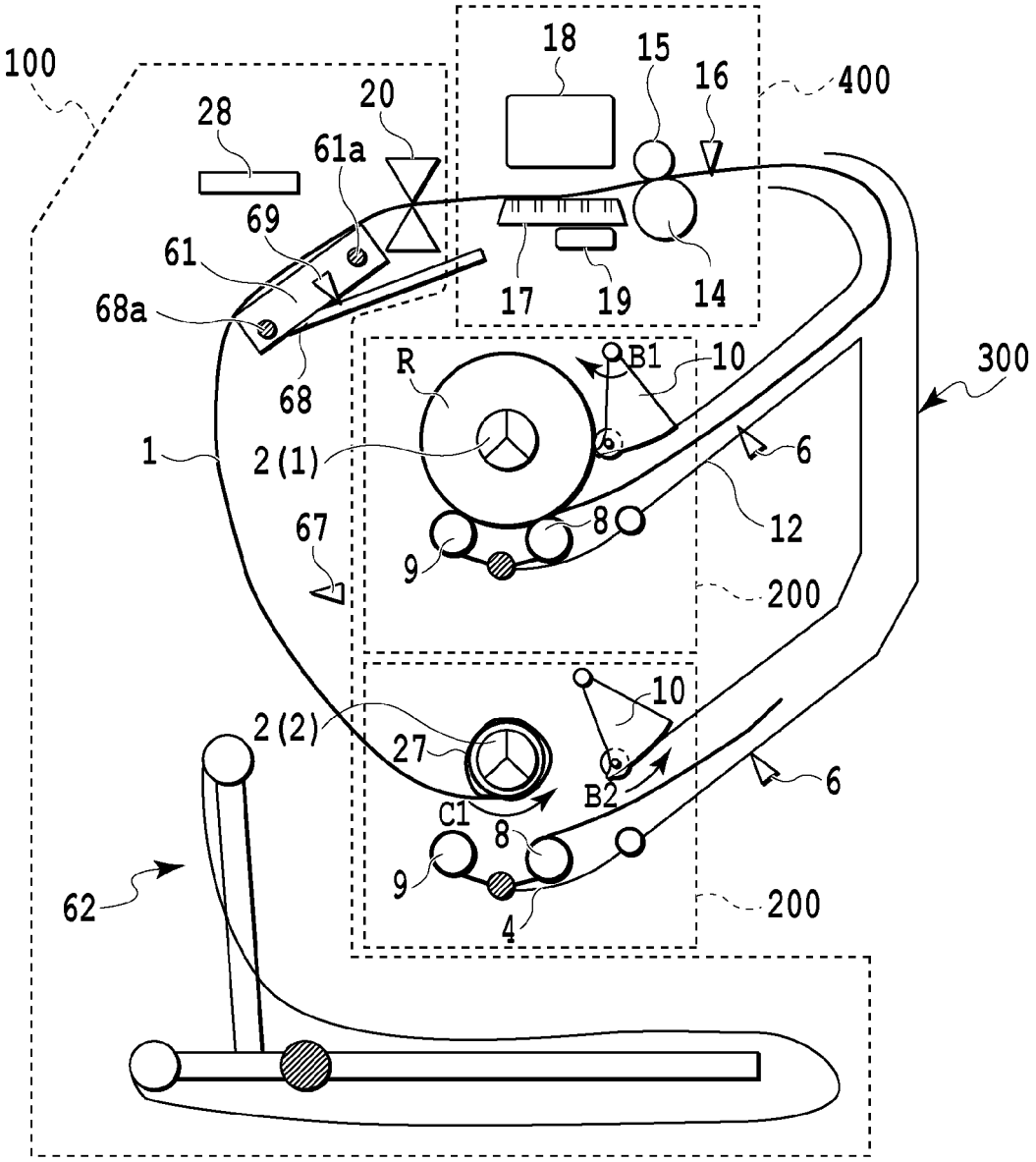
FIG. 20 is a view illustrating the printing apparatus shown in FIG. 19, in which a sheet is set in an outward wound manner.

In the present embodiment, as shown in FIGS. 19 and 20, the upper supplying apparatus 200 is used as a supplying unit for the sheet 1 whereas the lower supplying apparatus 200 is used as a winding unit for the sheet 1. In the lower supplying apparatus 200 shown in FIG. 19, the sheet 1 having an image printed thereon is wound in the state in which a print side faces inward (inward winding): in contrast, in the lower supplying apparatus 200 shown in FIG. 20, the sheet 1 having an image printed thereon is wound in the state in which a print side faces outward (outward winding). Like in the above-described eighth embodiment, the plurality of separating flappers 10 are arranged in the widthwise direction of the sheet roll R, and they can swing in directions indicated by the arrows B1 and B2. Explanation on the same configuration and operation as those in the above-described first embodiment is omitted here.

Figure 21A:
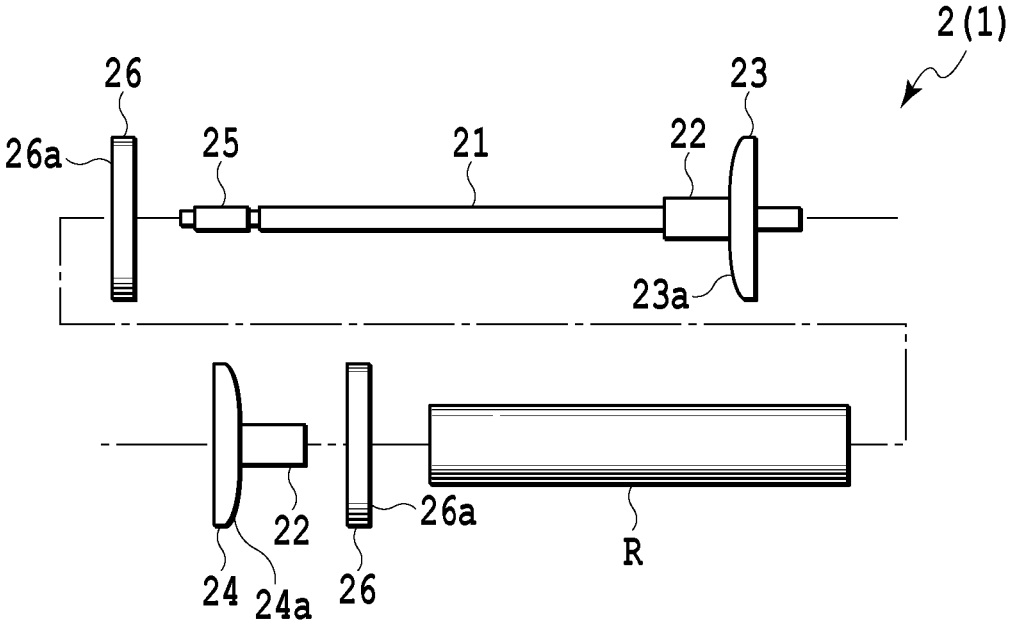
FIG. 21A is an exploded view showing one of spools in a sheet supplying apparatus shown in FIG. 19

The sheet roll R is set in the upper supplying apparatus 200 serving as the supplying unit by a spool member 2(1) shown in FIG. 21A. The spool member 2(1) is configured such that tapered guide faces 23*a* and 24*a* are formed inside of the spool flanges 23 and 24, respectively, in the above-described spool member 2 shown in FIG. 3A, and furthermore, flange attachments 26 are provided inside of the spool flanges 23 and 24, respectively. The flange attachment 26 on the side of the spool flange 23 functions as a spool flange on a reference side for the sheet roll R: in contrast, the flange attachment 26 on the side of the spool flange 24 functions as a spool flange on a non-reference side for the sheet roll R.

Figure 21B:
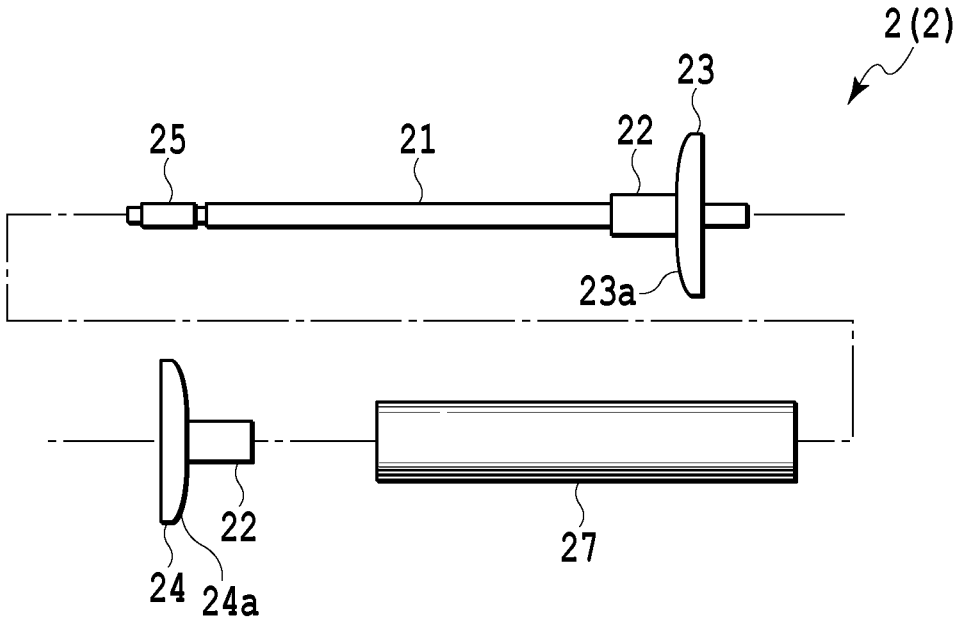
FIG. 21B is an exploded view showing the other spool in the sheet supplying apparatus shown in FIG. 19.

In contrast, a sheet core 27 is set in the lower supplying apparatus 200 used as the winding unit by a spool member 2(2) shown in FIG. 21B. The spool member 2(2) is the same as the spool member 2(1), from which the flange attachments 26 are detached, and furthermore, the sheet core 27 is set in place of the sheet roll R. The guide faces 23*a* and 24*a* of spool flanges 23 and 24 function as guides for the sheet 1 to be wound around the sheet core 27. In the case of the use of the spool member 2(1) for winding the sheet 1, concerns rise that creases occur on the sheet 1 caused by a contact with the flange attachment 26. However, the spool member 2(2) obtained by detaching the flange attachments 26 from the spool member 2(1) is used for winding the sheet 1, thereby eliminating such concerns. The spool member 2(1) for supplying the sheet 1 and the spool member 2(2) for winding the sheet 1 may be configured in the same manner.

Figure 22:
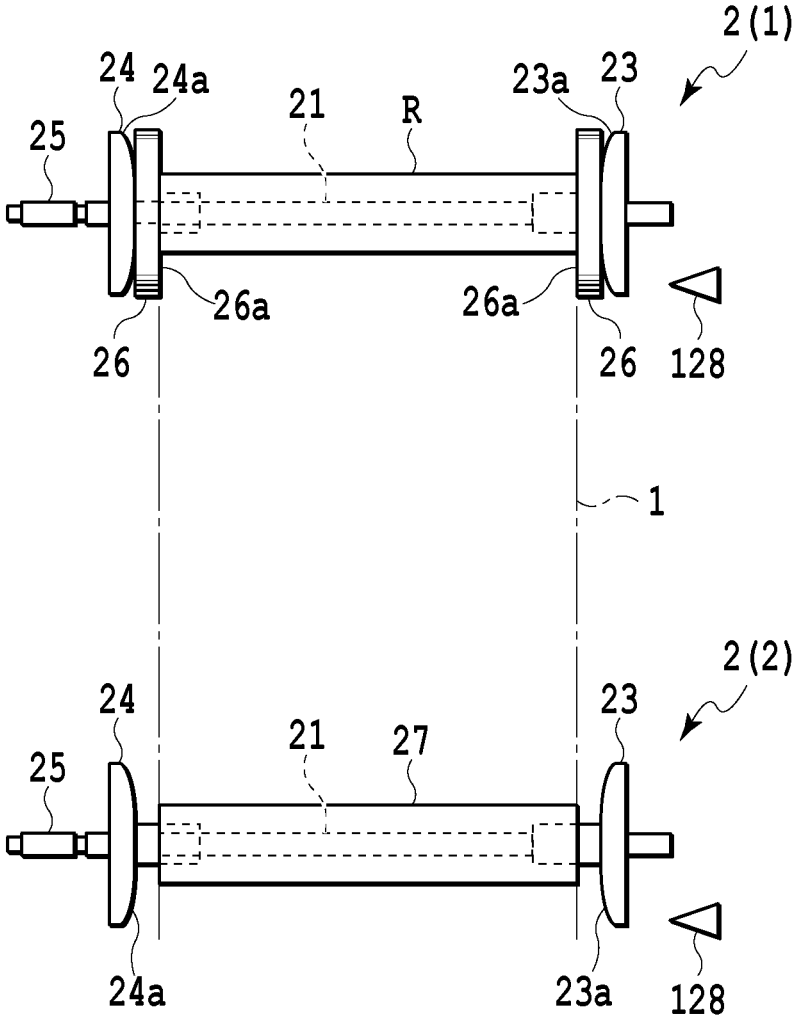
FIG. 22 is a view illustrating a spool in the sheet supplying apparatus shown in FIG. 19.

FIG. 22 is a front view showing the upper supplying apparatus 200 used as the supplying unit and the lower supplying apparatus 200 used as the winding unit that are vertically arranged for the sake of the explanation of their relationship. The tip of the sheet 1 wound around the sheet roll R is taped onto the sheet core 27.

In the spool member 2(1) for supplying the sheet 1, an inside end of the flange attachment 26 provided for the spool member 2(1) is a flat face 26*a*. Therefore, the edge of the sheet roll R abuts against the flat face 26*a* so that the sheet roll R can be positioned in the widthwise direction. The flat face 26*a* may not always be formed on the spool flange 24 on the non-reference side. The flange attachment 26 may be removed from the spool flange 24 on the non-reference side, and then, the spool member 2(1) is used as the spool member 2(2) for winding the sheet. In the meantime, a distance between the spool flanges 23 and 24 is set to be greater than the width of the sheet 1 in the spool member 2(2) for winding the sheet 1, and further, the guide faces 23*a* and 24*a* are tapered. As a consequence, skewing of the sheet 1 to be wound around the sheet core 27 is permitted to some extent.

The upper and lower supplying apparatuses 200 are provided with sensors (e.g., reflection type sensors) 128 for detecting the flange attachments 26, respectively. The CPU 201 (see FIG. 8) can determine which of the upper and lower supplying apparatuses 200 is used for supplying or winding the sheet based on results detected by the sensors 128. Specifically, in a case where the flange attachment 26 is attached to the spool flange 23 on the reference side of the set spool member, this supplying apparatus 200 having the spool member set therein is determined as the supplying apparatus 200 for supplying the sheet. On the other hand, in a case where no flange attachment 26 is attached to the spool flange 23 on the reference side of the set spool member, this supplying apparatus 200 having the spool member set therein is determined as the supplying apparatus 200 for winding the sheet. A user may use a switch so as to determine which of the upper supplying apparatus or the lower supplying apparatus is used for supplying or winding the sheet. Here, the determination is not limited to this method.

Figure 23B:
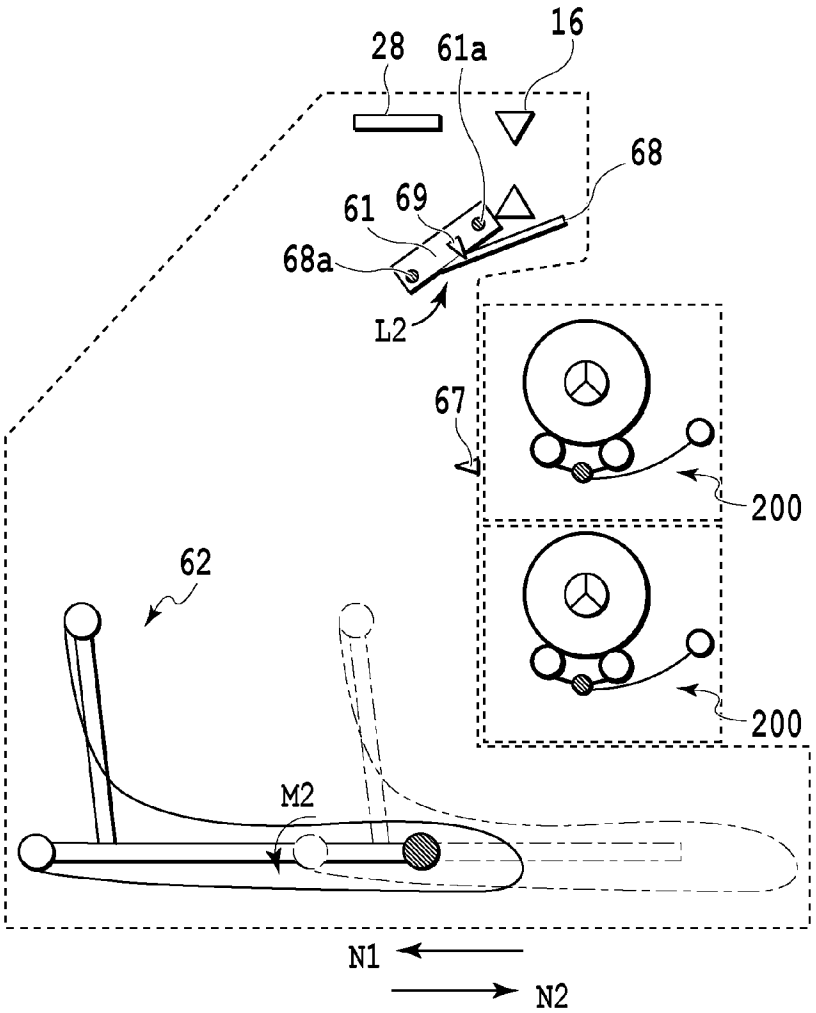
FIG. 23B is a view illustrating operation without using the basket in the sheet supplying apparatus.
Figure 23A:
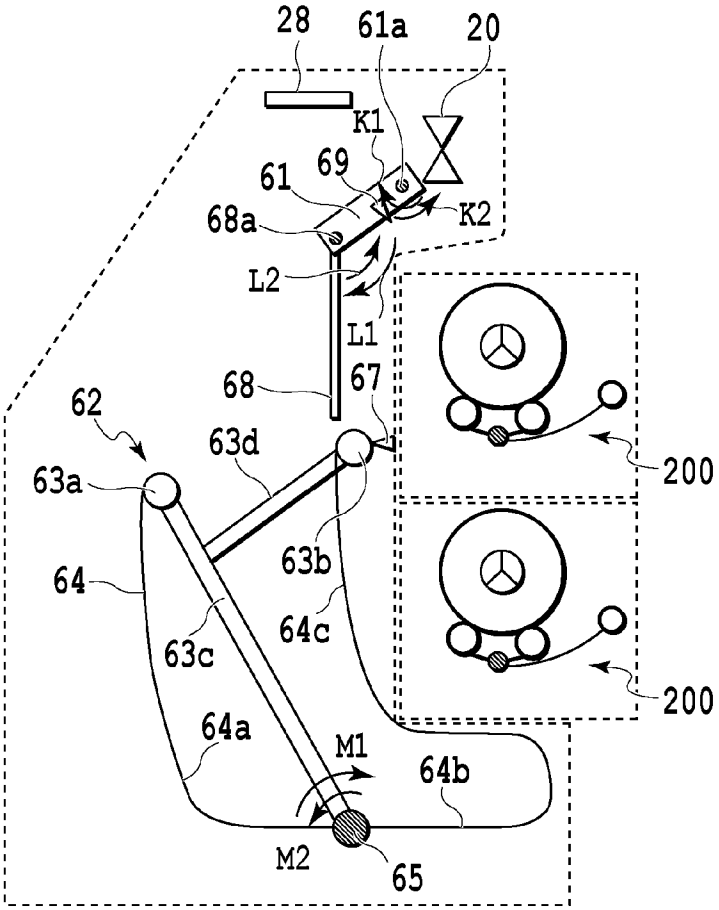
FIG. 23A is a view illustrating operation during use of a basket in the sheet supplying apparatus shown in FIG. 19

In the present embodiment, as shown in FIG. 23A, a sheet discharging guide 61 is provided for guiding the sheet 1 cut by the cutter 20 to a basket 62.

The sheet discharging guide 61 can be turned on a shaft 61*a* in directions indicated by arrows K1 and K2. The sheet discharging guide 61 is turned to a position shown in FIG. 23A in guiding the sheet 1, and furthermore, is turned to a retraction position, not shown, in setting the sheet roll R. To the sheet discharging guide 61 is attached a guide member 68 that can be turned in directions indicated by arrows L1 and L2 on a shaft 68*a*. The guide member 68 can move to a position at which it suspends by its own weight, as shown in FIG. 23A, and to a position at which it is housed on the side of the sheet discharging guide 61, as shown in FIG. 23B. The guide member 68 is obtained by forming a wire. The sheet discharging guide 61 is provided with a position detecting sensor 69, which outputs a detection signal in a case where the guide member 68 is housed on the side of the sheet discharging guide 61, as shown in FIG. 23B.

The basket 62 includes rods 63*a*, 63*b*, 63*c*, and 63*d* and a cloth member 64 having portions 64*a* to 64*c*. The rod 63*d* is joined to the rod 63*c*. Two pairs of joints, each having the rods 63*c* and 63*d*, are arranged on both sides in the widthwise direction of the sheet 1 (i.e., as viewed from the obverse to the reverse in the sheet of FIG. 23A). Base ends of the rods 63*c* at the two pairs of joints are fixed to members 65 on both sides in the widthwise direction of the sheet 1 on a stand of the printing apparatus 100 in a manner turnable in directions indicated by arrows M1 and M2. The rod 63*a* extending in a horizontal direction stretches between the tips of the rods 63*c* at the two pairs of joints. Similarly, the rod 63*b* extending in the horizontal direction extends between the tips of the rods 63*d* at the two pairs of joints. The two pairs of joints are connected to each other via the rods 63*a* and 63*b*. The cloth member 64 is flat, is fixed at one end thereof to the rod 63*a* whereas at the other end thereof to the rod 63*b*. In this manner, as shown in FIG. 23A, the rod 63*c* is turned in the direction indicated by the arrow M1, so that the basket 62 is kept open. At this time, the middle portion of the cloth member 64 is slackened, thereby forming a containing space for the sheet 1. The printing apparatus 100 is provided with a position detecting sensor 67, which detects the rod 63*d* in the open state of the basket 62 so as to output a detection signal.

The base end of the rod 63*c* is attached to the member 65 on the side of the printing apparatus 100 in a manner turnable in the directions indicated by the arrows M1 and M2, and furthermore, is attached in a manner slidable in directions indicated by horizontal arrows N1 and N2. In a case where the basket 62 is not used, the rod 63*c* is turned in the direction indicated by the arrow M2, as depicted by a solid line in FIG. 23B, and then, slid in the direction indicated by the arrow N2, as depicted by a virtual line in FIG. 23B, so that the basket 62 is housed at the lower section of the printing apparatus 100.

In the present embodiment, as shown in FIGS. 19 and 20, the upper supplying apparatus 200 is used as the supplying unit for the sheet 1 whereas the lower supplying apparatus 200 is used as the winding unit for the sheet 1. At this time, as shown in FIGS. 19 and 20, the guide member 68 and the basket 62 are moved to their housing positions in such a manner as not to interfere with the sheet 1. In this state, the position detecting sensor 69 detects the guide member 68 thereby turns on whereas the position detecting sensor 67 does not detect the basket 62 thereby turns off.

Figure 24:
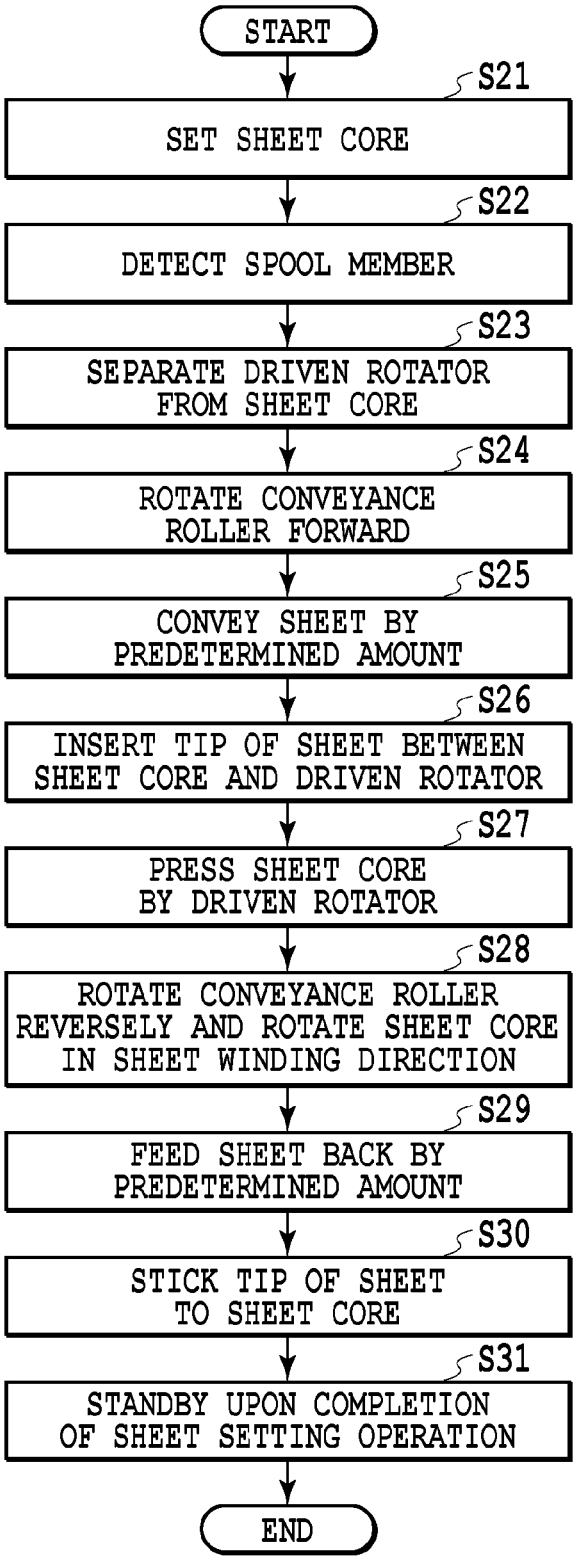
FIG. 24 is a flowchart illustrating a sheet setting operation in the printing apparatus shown in FIG. 19.

FIG. 24 is a flowchart illustrating work procedures after the setting of the sheet core 27 until the tip of the sheet 1 is set at the sheet core 27.

First, the spool member 2(2) is inserted into the sheet core 27, and then, the spool member 2(2) is set at the spool holder 31 (see FIG. 3C) of the lower supplying apparatus 200 (step S21). After the roll sensor 32 (see FIG. 3C) detects that the spool member 2(2) is set (step S22), the driven rollers 8 and 9 in the lower supplying apparatus 200 are separated from the sheet core 27 (step S23). That is to say, the arm member 4 is turned by the drive unit 3 in the direction indicated by the arrow A2. The separating flapper 10 can swing in the directions indicated by the arrows B1 and B2, like in the above-described eighth embodiment. The separating flapper 10 in the present embodiment is manually moved to the retraction position in the direction indicated by the arrow B2 by a user, as described later.

Thereafter, like in the above-described embodiments, the sheet 1 supplied from the sheet roll R set at the upper supplying apparatus 200 is conveyed. Specifically, the conveyance roller 14 is rotated forward in the direction indicated by the arrow D1 by the conveyance roller driving motor 35 (see FIG. 8) (step S24), and then, the sheet 1 is conveyed by predetermined amount (step S25). In this manner, the tip of the sheet 1 reaches to the sheet core 27 set in the lower supplying apparatus 200. Thereafter, the user inserts the tip of the sheet 1 between the sheet core 27 and the driven rollers 8 and 9 (step S26).

The separating flapper 10 is kept in the state in which the separating flapper 10 is allowed to be turned in the direction indicated by the arrow B1 by its own weight, as shown in FIG. 19 (i.e., a press-contact state) in a case where the sheet 1 is set in an inward wound manner, as shown in FIG. 19. In contrast, in a case where the sheet 1 is set in an outward wound manner, as shown in FIG. 20, the user turns the separating flapper 10 to the retraction position in the direction indicated by the arrow B2, as shown in FIG. 20. Specifically, the user operates a lever, not shown, so that the cam 10*g* in the above-described eighth embodiment (see FIG. 18) slides in the direction indicated by the arrow J1, thereby turning the separating flapper 10 to the retraction position in the direction indicated by the arrow B2. At the same timing as step S23, the user may be urged to operate the lever. Alternatively, the separating flapper 10 may be automatically swung by the use of a motor or the like.

The switch of the status of the separating flapper 10 according to the inward wound set and the outward wound set of the sheet 1 produces the following advantages.

In a case where the sheet 1 is inward set, as shown in FIG. 19, the tip of the sheet 1 curled, as indicated by a chain double-dashed line in FIG. 19, need be wound around the sheet core 27 reversely to the curl. In other words, the tip of the sheet 1 need pass through the back side of the sheet core 27 (i.e., right in FIG. 19) above the sheet core 27, to be then stuck to the sheet core 27 via a tape. At this time, as described above, since the separating flapper 10 remains in the press-contact state, the separating flapper 10 can guide the tip of the sheet 1 even in the case of the sheet 1 having a high rigidity or a great weight. As a consequence, the tip of the sheet 1 is smoothly guided up to a fixture position at which the tip of the sheet 1 is to be taped to the sheet core 27, thus enhancing the fixing workability of the tip of the sheet 1.

In contrast, in a case where the sheet 1 is set outward, as shown in FIG. 20, the tip of the sheet 1 is wound around the sheet core 27 in the same manner as its curl. At this time, as described above, since the separating flapper 10 is moved to the separate position, the tip of the sheet 1 can be wound around the sheet core 27 without any interference by the separating flapper 10 by utilizing the curl of the tip of the sheet 1. In a case where the separating flapper 10 is in the press-contact state, a tape that fixes the tip of the sheet 1 to the sheet core 27 possibly peels off by the separating flapper 10. In the present embodiment, the separating flapper 10 is moved to the separate position, thus preventing the tape from peeling off, and furthermore, preventing the sheet 1 from being torn caused by the peeling-off.

In this manner, the tip of the sheet 1 is inserted between the sheet core 27 and the driven rollers 8 and 9, and then, the user operates the operation panel 28, so that the driven rollers 8 and 9 in the lower supplying apparatus 200 press the sheet core 27 (step S27). Specifically, the arm member 4 is turned by the drive unit 3 in the direction indicated by the arrow A1. Moreover, in a case where the separating flapper 10 is in the press-contact state, the user moves the separating flapper 10 to the separate position.

Thereafter, the conveyance roller driving motor 35 rotates the conveyance roller 14 reversely in the direction indicated by the arrow D2, and furthermore, the roll driving motor 33 at the lower supplying apparatus 200 rotates the sheet core 27 in the sheet winding direction together with the spool member 2(2) (step S28). In the case of the inward setting of the sheet 1, as shown in FIG. 19, the sheet winding direction is indicated by the arrow C2: in contrast, in the case of the outward setting of the sheet 1 shown in FIG. 20, the sheet winding direction is indicated by the arrow C1. Consequently, irrespective of the inward or outward setting, the conveyance roller 14 is rotated in the direction in which the sheet 1 is fed from the sheet core 27, and conversely, the sheet core 27 is rotated in the direction in which the sheet 1 is wound. A friction force between the conveyance roller 14 and the sheet 1 is much more strongly set than that between the sheet core 27 and the sheet 1, and therefore, the sheet 1 is fed back. After the sheet 1 is fed back by predetermined amount (step S29), the conveyance roller driving motor 35 and the roll driving motor 33 in the lower supplying apparatus 200 are stopped.

The above-described feedback of the sheet 1 applies tension onto the sheet 1. The sheet 1 is fed back with the application of tension, thereby eliminating sag on the sheet 1 to be wound around the sheet core 27 so as to correct skewing. After the sheet 1 is fed back by predetermined amount, the tip of the sheet 1 is taped to the sheet core 27 (step S30), thus completing the setting of the sheet 1, whereby the apparatus 200 stands by (step S31). When the sheet 1 is fed back by predetermined amount, the tip of the sheet 1 is moved to a position at which it is readily fixed to the sheet core 27.

Figure 25:
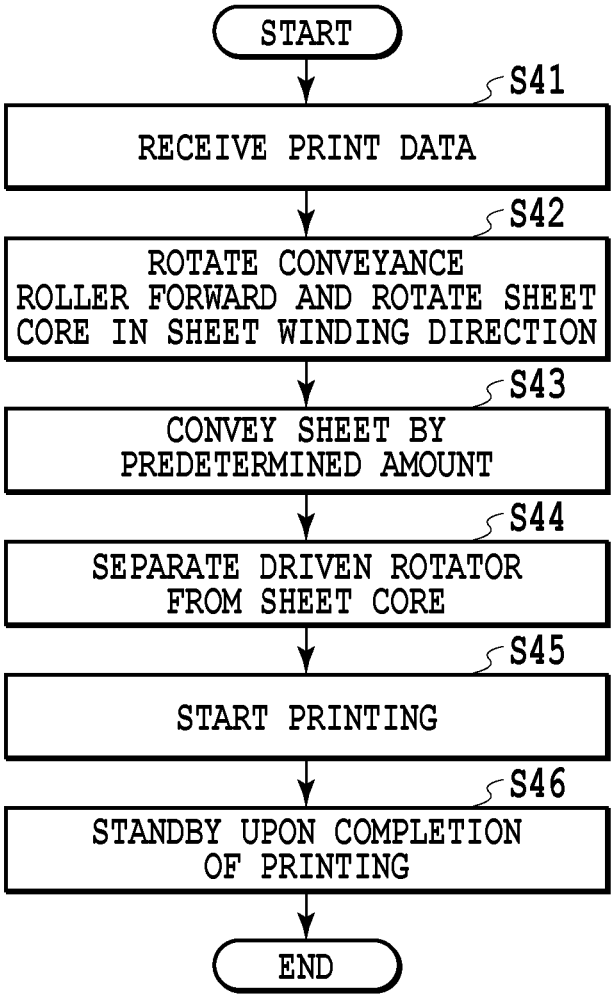
FIG. 25 is a flowchart illustrating a printing operation in the printing apparatus shown in FIG. 19.

FIG. 25 is a flowchart illustrating operation for printing an image on the sheet 1 while winding the sheet 1 around the sheet core 27 after step S31 in FIG. 24.

Upon receipt of print data from a host apparatus such as a personal computer, the conveyance roller 14 is rotated in the direction indicated by the arrow D1 in the printing apparatus 100, and further, the sheet core 27 in the lower supplying apparatus 200 is rotated in the sheet winding direction (step S42). In this manner, the sheet 1 is conveyed by predetermined amount (step S43), and then, the driven rollers 8 and 9 in the lower supplying apparatus 200 are separated from the sheet core 27 by the drive unit 3 (step S44), and thus, printing an image is started (step S45). The roll driving motor 33 in the lower supplying apparatus 200 rotates the sheet core 27 together with the spool member 2(2) in the winding direction according to the conveying operation of the sheet 1 by the conveyance roller 14, and thus, the sheet 1 is wound up. At this time, a drive current to the roll driving motor 33 is restricted to controllably prevent the sheet 1 from being pulled by a torque (i.e., tension) more than or equal to a predetermined torque. With this control, the sheet 1 can be stably conveyed. Should the tension more than required occur, the conveyance accuracy of the sheet 1 is reduced. After the completion of the printing operation, the printing apparatus 100 stands for a similar printing operation, that is, operation for printing an image on the sheet 1 while winding the sheet 1 around the sheet core 27 (step S46).

Next, explanation will be made on the operations of the driven rollers 8 and 9 and the separating flapper 10 during the above-described printing operation.

In the present embodiment, the driven rollers 8 and 9 and the separating flapper 10 are separated from the sheet 1 to be wound around the sheet core 27. However, in the case of winding a sheet having a high rigidity in the inward wound manner, the sheet 1 need be wound against a strong curl. During the sheet winding, "winding looseness," meaning unwinding of the once wound sheet, possibly occurs. In the meantime, in the printing apparatus requiring miniaturization and cost reduction need wind sheets having various rigidities, thicknesses, and weights at limited motor torques. In a case where such sheets are wound, the driven rollers 8 and 9 and the separating flapper 10 are brought into press-contact with the sheet, thereby suppressing the occurrence of "winding looseness" of the sheet even by using a low torque motor. Moreover, the driven rollers 8 and 9 and the separating flapper 10 are brought into the press-contact state in this manner, thus suppressing an expanding force of the sheet to be wound around the sheet core 27, so as to stabilize the winding operation. In the case of, in particular, the inward sheet winding, the driven rollers 8 and 9 are brought into press-contact with a non-print side of the sheet, so that little adverse influence is exerted on an image print side. In the same manner, the separating flapper 10 is brought into press-contact with the sheet, thus suppressing the occurrence of the "winding looseness" of the sheet. In order to enhance the suppression effect of the "winding looseness" of the sheet, the separating flapper 10 may be brought into press-contact with the sheet by not the weight of the separating flapper 10 but an urging member such as a spring, not shown.

In contrast, in the case of winding a sheet having a low rigidity and a fine surface, it is desirable that the driven rollers 8 and 9 and the separating flapper 10 should be separated from the sheet. The press-contact or separation of the driven rollers 8 and 9 and the separating flapper 10 with or from the sheet may be switched according to the physical properties of the sheet (such as a rigidity, a thickness, and a weight), the sheet winding direction (i.e., inward or outward winding), a sheet surface condition, ambient temperature, and the like. Consequently, various kinds of sheets can be wound in an optimal state.

Figure 26:
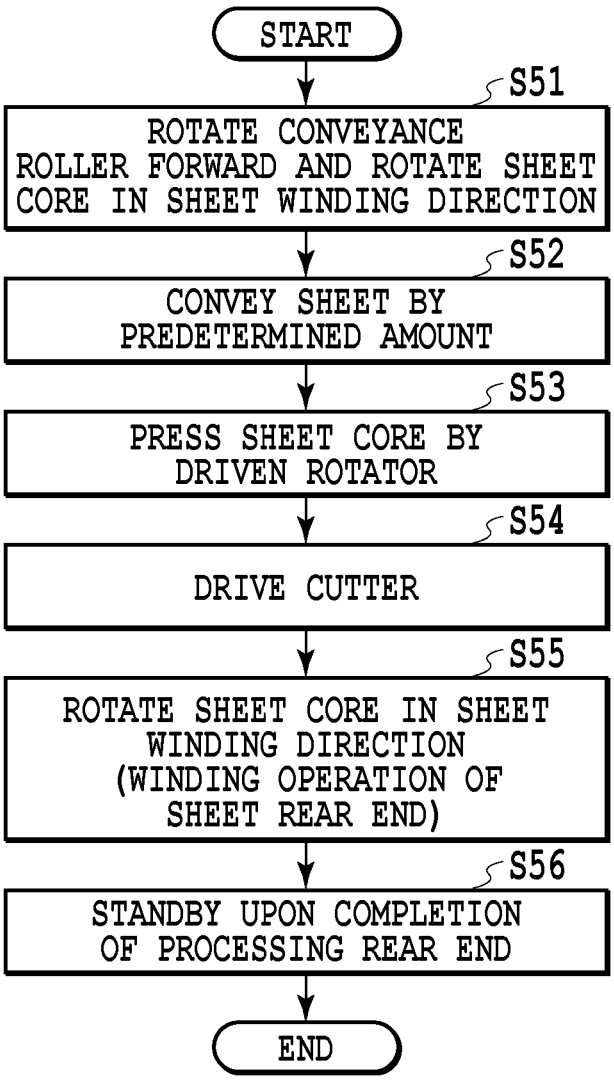
FIG. 26 is a flowchart illustrating sheet rear end processing in the printing apparatus shown in FIG. 19.

FIG. 26 is a flowchart illustrating an operation for processing a rear end of a sheet 1 after the above-described printing operation, during which the sheet 1 is wound.

A user instructs the start of the processing for a rear end of the sheet 1 via the operation panel 28. In this manner, the conveyance roller 14 is rotated forward in the direction indicated by the arrow D1 by the conveyance roller driving motor 35, and furthermore, the sheet core 27 is rotated in the sheet winding direction together with the spool member 2(2) by the roll driving motor 33 in the lower supplying apparatus 200 (step S51). In this manner, after the sheet 1 is conveyed by predetermined amount while the sheet 1 is wound (step S52), the drive unit 3 in the lower supplying apparatus 200 presses the driven rollers 8 and 9 against the sheet core 27 (step S53).

At this time, in a case where the driven rollers 8 and 9 are brought into contact with the image print side of the sheet 1, ink is possibly transferred thereonto. In view of this, in step S52, it is desirable that the sheet 1 should be conveyed by predetermined amount so that the image print side of the sheet 1 should be shifted downstream of the driven rollers 8 and 9 in the conveyance direction such that the driven rollers 8 and 9 are not brought into contact with the print side. In a case where the contact of the driven rollers 8 and 9 with the print side of the sheet 1 is inevitable, the print side may be sufficiently dried, before the driven rollers 8 and 9 are brought into contact with the print side. Alternatively, the print side of the sheet 1 may be subjected to treatment such as fluorine coating, before the driven rollers 8 and 9 are brought into contact with the print side.

Thereafter, the cutter 20 is driven by a cutter driving motor, not shown, to cut the sheet 1 (step S54). When the sheet 1 is cut, a user may hold a rear end of the sheet 1 wound around the sheet core 27 so as to prevent the falling of the rear end of the sheet 1. Thereafter, upon operation of the operation panel 28 by the user, the sheet core 27 is rotated in the sheet winding direction by the roll driving motor 33 in the lower supplying apparatus 200 (step S55). In this manner, the rear end of the sheet 1 is wound around the sheet core 27. After that, the rear end of the sheet 1 is taped onto the sheet core 27, thereby completing the processing for the rear end of the sheet, so that the printing apparatus comes to a standby state (step S56).

As described above, in step S53 onwards, the driven rollers 8 and 9 are pressed against the surface of the sheet 1 wound around the sheet core 27. As a consequence, between steps S54 to S56, even in a case where sag occurs on the sheet 1 between the rear end of the sheet 1 and a position at which the driven rollers 8 and 9 are pressed against the sheet 1, no winding looseness caused by the sag occurs on the sheet 1 wound around the sheet core 27. With the above-described function of the driven rollers 8 and 9, the user need not take special care of the looseness of the sheet 1 wound around the sheet core 27. In addition, the user need not tightly wind a loosened sheet 1, and therefore, in tightly winding a sheet 1, the print side of the sheet 1 does not rug, thus preventing any occurrence of a rugged scar. Additionally, the lower supplying apparatus 200 functions also as a winding apparatus for the sheet 1.

Tenth Embodiment

Figure 27:
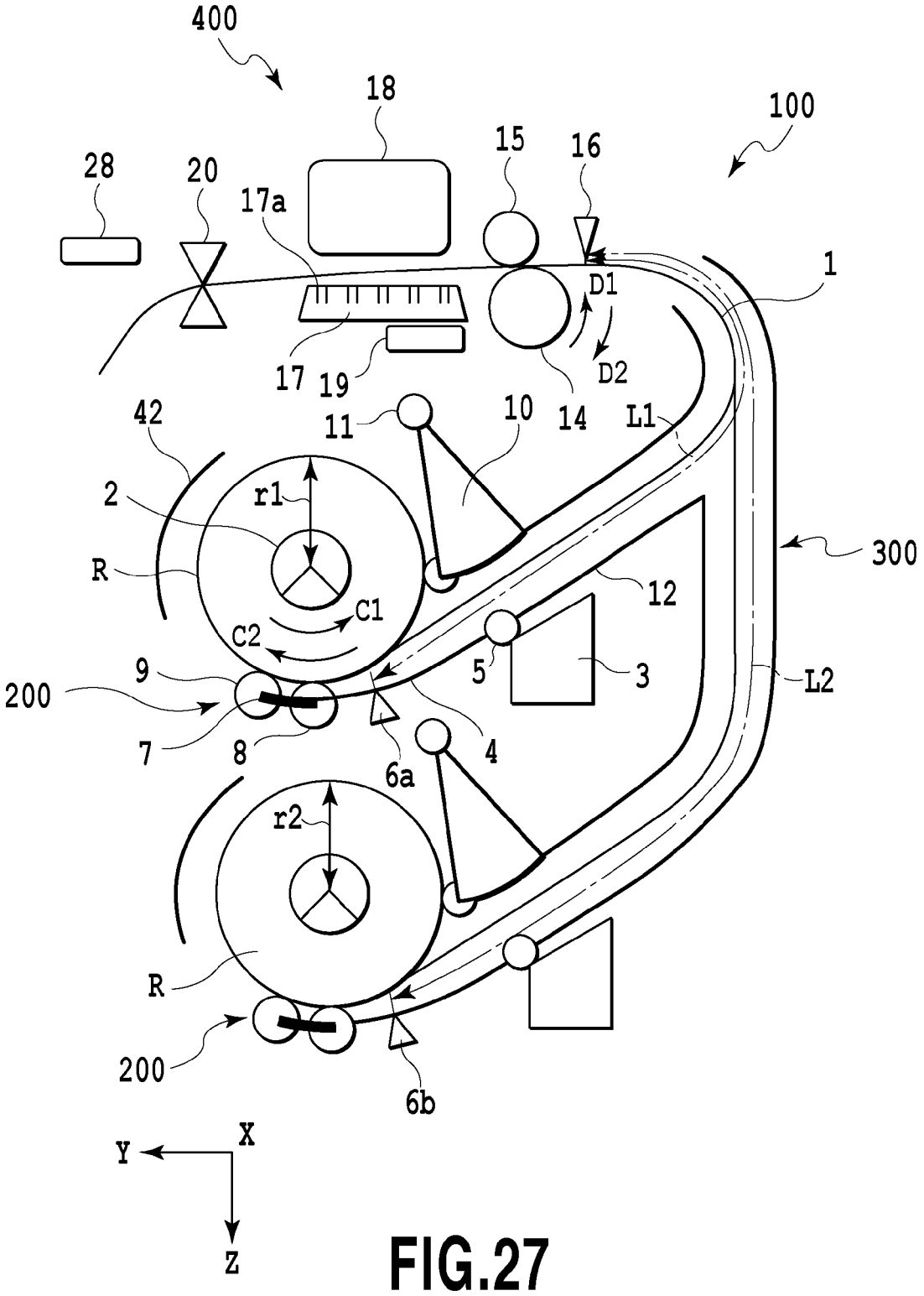
FIG. 27 is a view illustrating essential parts of a printing apparatus in a tenth embodiment of the present invention.
Figure 28:
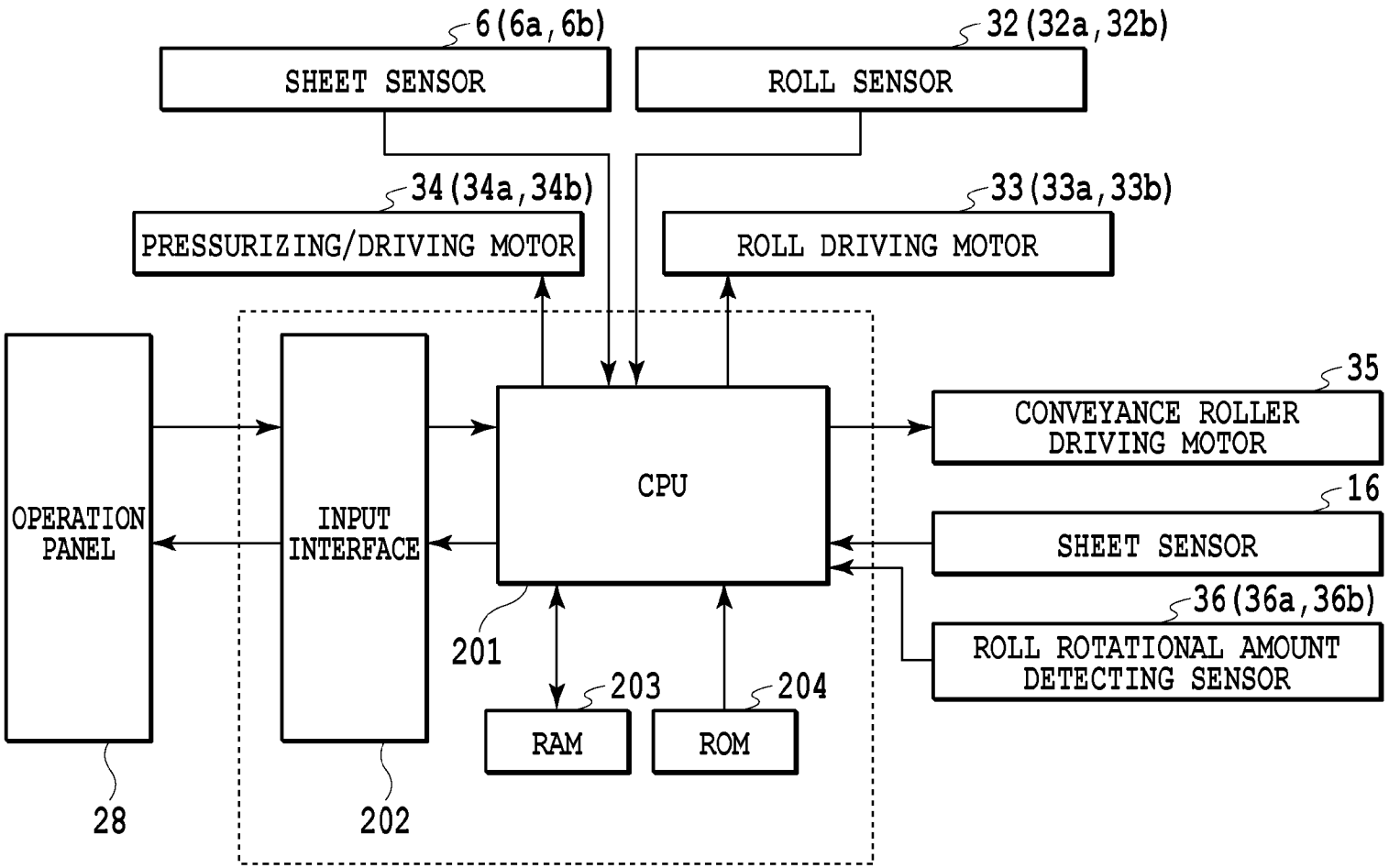
FIG. 28 is a block diagram illustrating a control system of the printing apparatus shown in FIG. 27.
Figures 29, 29A, 29B:
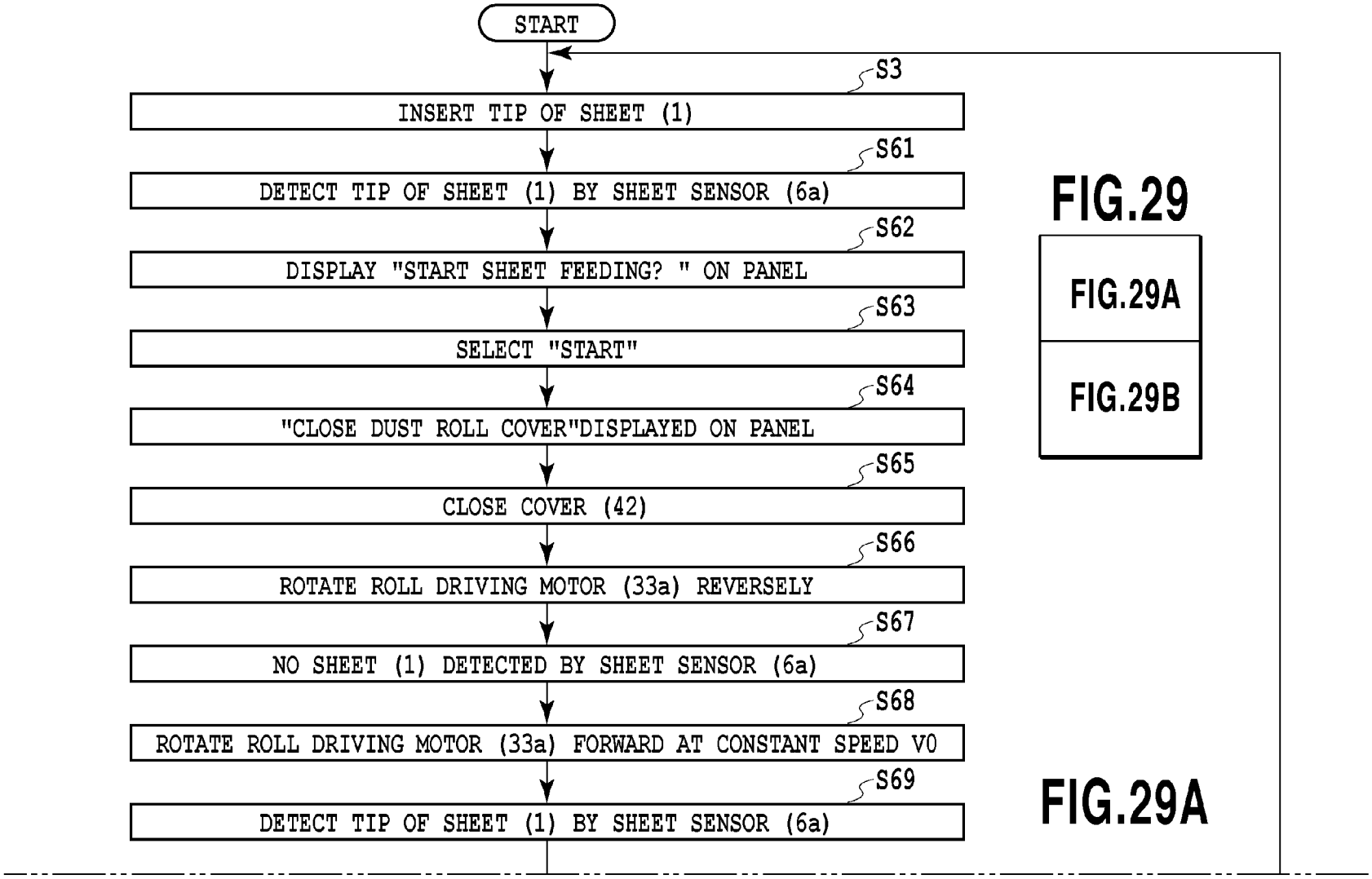
FIG. 29 is a diagram showing a relation between FIG. 29A and FIG. 29B.
FIG. 29A and FIG. 29B are flowcharts illustrating operation in the printing apparatus shown in FIG. 27.
Figure 29B:
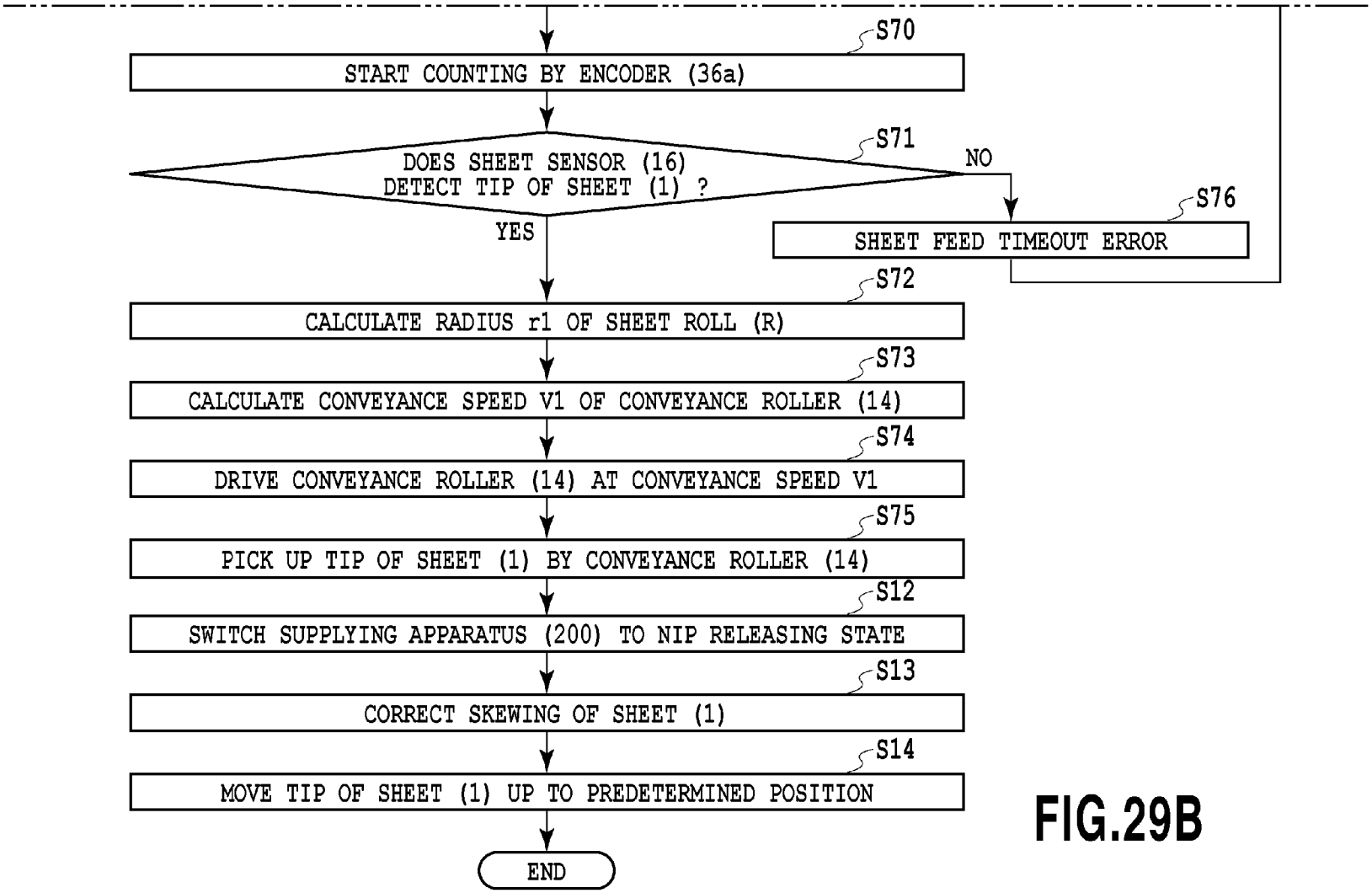

FIGS. 27 to 29 illustrate a tenth embodiment of the present invention.

Like in the above-described first embodiment, each of upper and lower supplying apparatuses 200 is provided with the sheet sensor 6. In the following explanation, as shown in FIG. 27, the sheet sensor 6 in the upper supplying apparatus 200 is referred to as a sheet sensor 6*a* whereas the sheet sensor 6 in the lower supplying apparatus 200 is referred to as a sheet sensor 6*b*. Likewise, the roll sensor 32, the roll driving motor 33, and the pressurizing/driving motor 34 provided in each of the supplying apparatuses 200 are denoted by reference numerals 32*a*, 33*a*, and 34*a* in the upper supplying apparatus 200 whereas they are denoted by reference numerals 32*b*, 33*b*, and 34*b* in the lower supplying apparatus 200. FIG. 28 is a block diagram illustrating a control system in the printing apparatus 100. Explanation on the same configuration and operation as those in the above-described first embodiment is omitted.

In the present embodiment, encoders (i.e., roll rotational amount detecting sensors) 36*a* and 36*b* for detecting the rotational amounts of the roll driving motors 33*a* and 33*b* are provided for the roll driving motors 33*a* and 33*b*, respectively. The CPU 201 detects a feed speed of the tip of the sheet 1 to be fed from the sheet roll R in response to detection signals from the encoders 36*a* and 36*b*. Moreover, the CPU 201 controls, based on the feed speed of the tip of the sheet 1, a conveyance speed of the sheet 1 at a time when the tip of the sheet 1 intrudes between the conveyance roller 14 and the nip roller 15.

FIG. 29 is a flowchart illustrating the control of the conveyance speed of the sheet 1 at the time when the tip of the sheet 1 intrudes between the conveyance roller 14 and the nip roller 15, the control being performed between step S3 and step S14 in FIG. 7 in the above-described first embodiment. Explanation will be made below on a case where the sheet 1 is supplied from the sheet roll R set in the upper supplying apparatus 200. It is similar in the case where the sheet 1 is supplied from the lower supplying apparatus 200.

In step S3, like in FIG. 7 in the above-described first embodiment, a user eliminates sag on the sheet 1 around the sheet roll R set in the supplying apparatus 200, and then, inserts the tip of the sheet 1 between the arm member 4 and the separating flapper 10. Upon detection of the tip of the sheet 1 by the sheet sensor 6*a* (step S61), the CPU 201 displays a message "Start sheet feeding?" on the display of the operation panel 28 (see FIG. 1) (step S62). After the selection of "Start" on the operation panel 28 by the user (step S63), the CPU 201 displays a message "Close dust roll cover" on the display of the operation panel 28 (step S64). In response to this message, the user closes the cover 42 at the upper supplying apparatus 200 (step S65). The CPU 201 rotates the roll driving motor 33*a* reversely to rotate the sheet roll R once in the direction indicated by an arrow C2 (step S66). After the sheet sensor 6*a* becomes a state of detecting no sheet 1 (step S67), the CPU 201 rotates the roll driving motor 33*a* forward at a temporary constant speed V0, thereby rotating the sheet roll R in the direction indicated by the arrow C1 (step S68). After the sheet sensor 6*a* detects the tip of the sheet 1 (step S69), the CPU 201 starts counting an output pulse (i.e., an encoder pulse) of the encoder 36*a*, that is, detecting the rotational amount of the roll driving motor 33*a* (step S70).

In a case where a sheet sensor 16 detects the tip of the sheet 1 fed according to the rotation of the sheet roll R in the direction indicated by the arrow C1, the CPU 201 calculates a radius r1 of the sheet roll R based on a count of the encoder pulses until that moment (steps S71 and S72). Unless the sheet sensor 16 detects the tip of the sheet after a lapse of a predetermined time, the CPU 201 determines a sheet feed timeout error, thus urging the user to reset the sheet 1 (step S76).

The CPU 201 calculates the radius r1 of the sheet roll R in accordance with the following equation (1).

$$r1=L1/2\pi N \quad (1)$$

Where, L1 (see FIG. 27) represents a conveyance distance between the sheet sensor 6*a* and the sheet sensor 16 and N represents a number of rotations of the sheet roll R calculated based on the count of the encoder pulses.

The CPU 201 calculates a feed speed V1 (=rω) of the sheet 1 based on the radius r1 and a rotational angular speed ω of the sheet roll R obtained from the rotational number N of the sheet roll R, and then, sets the speed V1 as the conveyance speed of the conveyance roller 14 (step S73). And then, the CPU 201 drives the conveyance roller 14, and furthermore, sets its conveyance speed as the feed speed V1 of the sheet 1 (step S74), thus reducing a shock caused by the intrusion of the tip of the sheet 1 between the conveyance roller 14 and the nip roller 15. As a consequence, the conveyance roller 14 and the nip roller 15 can securely pick up the tip of the sheet 1 (step S75), thereby suppressing occurrence of a jam.

Thereafter, like in FIG. 7 in the above-described first embodiment, the processing in steps S12 to S14 is performed.

In addition, in a case where the sheet 1 is supplied from the sheet roll R set in the lower supplying apparatus 200, the CPU 201 can calculate a radius r2 of the sheet roll R in accordance with the following equation (2).

$$r2=L2/2\pi N \quad (2)$$

Where, L2 (see FIG. 27) represents a conveyance distance between the sheet sensor 6*b* and the sheet sensor 16.

In this manner, the CPU 201 is equipped with both a function as a detector unit for detecting the feed speed of the tip of the sheet 1 and a function as a control unit for controlling the conveyance speed of the conveyance roller 14 based on the feed speed. Here, the feed speed of the tip of the sheet 1 may be input by an external detector unit. The calculated radius of the sheet roll may be used for other control.

Other Embodiments

The printing apparatus is not limited to only the configuration provided with the two sheet supplying apparatuses corresponding to the two sheet rolls, but it may be provided with a single sheet supplying apparatus or three or more sheet supplying apparatuses. Moreover, the printing apparatus is simply required to print an image on the sheet supplied by the sheet supplying apparatus, and therefore, it is not limited to only the ink jet printing apparatus. Furthermore, the print system and configuration of a printing apparatus are arbitrary. For example, the printing apparatus may be either of a serial scan system, in which printing/scanning by a print head and a sheet conveying operation are repeated so as to print an image, or of a full line system, in which a sheet is sequentially conveyed to a position facing an elongated print head so as to print an image.

The present invention is applicable to various kinds of sheet supplying apparatuses in addition to a sheet supplying apparatus for supplying a sheet serving as a print medium to a printing apparatus. For example, the present invention is applicable to an apparatus for supplying a sheet to be read to a reader such as a scanner or a copying machine, an apparatus for supplying sheet-like workpiece to a machining device such as a cutter, and the like. The above-described sheet supplying apparatuses may be configured independently of the printing apparatus, the reader, the machining device, and the like, and further, may be provided with a control unit (i.e., a CPU) for the sheet supplying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional application of U.S. patent application Ser. No. 14/939,115, filed on Nov. 12, 2015, and allowed on Oct. 20, 2016, which claims the benefit of Japanese Patent Applications No. 2014-234755, filed Nov. 19, 2014, No. 2015-165838, filed Aug. 25, 2015 which are hereby incorporated by reference wherein in their entirety.

What is claimed is:

1. A printing apparatus comprising:

a setting portion on which a roll sheet wound in a shape of a roll is set;

a pressing member configured to be movable between a first position for pressing an outer surface of the roll sheet set on the setting portion and a second position apart from the roll sheet set on the setting portion;

a printing unit configured to print on the roll sheet; and a control unit configured to move the pressing member to the first position in a first case where the roll sheet set on the setting portion is supplied to the printing unit, and to move the pressing member to the second position in a second case where a roll sheet having a first surface printed by the printing unit is wound on the setting portion.

2. The printing apparatus according to claim 1, wherein the setting portion comprises a holder configured to hold the roll sheet and a driver configured to rotate the holder.

3. The printing apparatus according to claim 2, wherein the driver rotates the holder in a first direction in the first case, and rotates the holder in a second direction in the second case.

4. The printing apparatus according to claim 1, wherein the pressing member moves according to an outer diameter of the roll so as to press the outer surface of the roll sheet in the first case.

5. The printing apparatus according to claim 4, wherein the pressing member contacts the outer surface of the roll sheet from below and moves upwardly according to the outer diameter of the roll in the first case.

6. The printing apparatus according to claim 1, further comprising a guide member configured to guide the roll sheet supplied from the setting portion to the printing unit in the first case.

7. The printing apparatus according to claim 6, wherein the guide member moves in association with the movement of the pressing member.

8. The printing apparatus according to claim 6, further comprising an upper member positioned above the guide member, the upper member moving according to an outer diameter of the roll so as to form a supply path between the upper member and the guide member through which the roll sheet is supplied to the printing unit in the first case.

9. A printing apparatus comprising:

a first setting portion on which a roll sheet wound in a shape of a roll can be set;

a second setting portion on which a roll sheet wound in a shape of a roll can be set;

a pressing member configured to be movable between a first position for pressing an outer surface of the roll sheet set on the second setting portion and a second position apart from the roll sheet set on the second setting portion;

a printing unit configured to print on the roll sheet supplied from the first setting portion or the second setting portion; and a control unit configured to move the pressing member to the first position in a first case where the roll sheet set on the second setting portion is supplied to the printing unit, and to move the pressing member to the second position in a second case where the roll sheet supplied from the first setting portion and printed by the printing unit is wound on the second setting portion.

10. The printing apparatus according to claim 9, wherein the second setting portion comprises a holder configured to hold the roll sheet and a driver configured to rotate the holder.

11. The printing apparatus according to claim 10, wherein the driver rotates the holder in a first direction in the first case, and rotates the holder in a second direction in the second case.

12. The printing apparatus according to claim 9, wherein the pressing member moves according to an outer diameter of the roll so as to press the outer surface of the roll sheet set on the second setting portion in the first case.

13. The printing apparatus according to claim 12, wherein the pressing member contacts the outer surface of the roll sheet set on the second setting portion from below and moves upwardly according to the outer diameter of the roll in the first case.

14. The printing apparatus according to claim 9, further comprising a guide member configured to guide the roll sheet supplied from the second setting portion to the printing unit in the first case.

15. The printing apparatus according to claim 14, wherein the guide member moves in association with the movement of the pressing member.

16. The printing apparatus according to claim 14, further comprising an upper member positioned above the guide member, the upper member moving according to an outer diameter of the roll so as to form a supply path between the upper member and the guide member through which the roll sheet set on the second setting portion is supplied to the printing unit in the first case.

17. The printing apparatus according to claim 9, wherein the printing unit is disposed above the first setting position and the second setting position is below the first setting position.

* * * * *